US007502491B2

(12) United States Patent
Shirai et al.

(10) Patent No.: US 7,502,491 B2
(45) Date of Patent: Mar. 10, 2009

(54) GOLF SWING DIAGNOSIS SYSTEM

(75) Inventors: Yoshiaki Shirai, Osaka (JP); Nobutaka Shimada, Osaka (JP); Masahiko Ueda, Hyogo (JP); Masahide Onuki, Hyogo (JP)

(73) Assignee: SRI Sports Limited, Kobe-Shi (JP)

( * ) Notice: Subject to any disclaimer, the term of this patent is extended or adjusted under 35 U.S.C. 154(b) by 941 days.

(21) Appl. No.: 10/956,227

(22) Filed: Oct. 4, 2004

(65) Prior Publication Data

US 2005/0143183 A1 Jun. 30, 2005

(30) Foreign Application Priority Data

Dec. 26, 2003 (JP) ..... 2003-433539
Mar. 26, 2004 (JP) ..... 2004-092419

(51) Int. Cl.
*G06K 9/00* (2006.01)

(52) U.S. Cl. ..... 382/107; 434/252

(58) Field of Classification Search ..... 382/100, 382/103, 107, 162, 203; 473/219, 257; 434/252
See application file for complete search history.

(56) References Cited

U.S. PATENT DOCUMENTS 7,376,245 B2 * 5/2008 Morozumi et al. ..... 382/103
2003/0109322 A1 * 6/2003 Funk et al. ..... 473/222
2004/0209698 A1 * 10/2004 Ueda et al. ..... 473/150
2006/0247070 A1 * 11/2006 Funk et al. ..... 473/222

FOREIGN PATENT DOCUMENTS

| | | | |
|---|---|---|---|
| EP | 0 447 712 | A2 | 9/1991 |
| GB | 2 400 568 | A | 10/2004 |
| JP | 2003-117045 | A | 4/2003 |

* cited by examiner

*Primary Examiner*—Andrew W Johns
(74) *Attorney, Agent, or Firm*—Birch, Stewart, Kolasch & Birch, LLP

(57) ABSTRACT

A computer (15) captures the colored moving image of the golfer (11) who swings by gripping a golf club (12) having colored marks (M1 through M3) attached to a shaft (12*a*) thereof. The computer (15) converts the colored moving image into a plurality of still images; executes binarization for each pixel of a plurality of the still images by using a specific threshold of color information and recognizes pixels, of the still images, which satisfy the threshold as positions of the colored marks (M1 through M3) and extracts a movement of the shaft (12*a*) by using a movement vector amount of one of the colored marks (M1 through M3 ) or by using a vector angle between two of the colored marks (M1 through M3). In this manner, the computer (15) automatically extracts check-point images.

21 Claims, 13 Drawing Sheets

GOLF SWING DIAGNOSIS SYSTEM

This nonprovisional application claims priority under 35 U.S.C. § 119(a) on Patent Application No(s). 2003-433539 filed in Japan on Dec. 26, 2003 and 2004-092419 filed in Japan on Mar. 26, 2004, the entire contents of which are hereby incorporated by reference.

BACKGROUND OF THE INVENTION

1. Field of the Invention

The present invention relates to a golf swing diagnosis system and more particularly to a system of automatically extracting check-point images effective for diagnosing a golfer's swing form with high accuracy.

2. Description of the Related Art

There are proposed various kinds of apparatuses of photographing a golfer's swing, automatically computing information such as the flight distance, orbit, and the like of a hit ball by a computer, and displaying the obtained information for a golfer. These apparatuses allow the golfer to examine the flight distance, orbit, and the like of the hit ball. However, these apparatuses are incapable of providing information useful for improving the golfer's swing form.

In the swing form diagnosis apparatus disclosed in Japanese Patent Application Laid-Open No. 2003-117045, a golfer's swing is photographed to extract images of only specific motion points important for diagnosing the swing form. More specifically, frames regarding the golfer's swing motion are extracted from the golfer's moving image photographed by the photographing means. Specific motion points during the swing motion are judged according to results of analysis of the moving partial images in the differential image between each frame and the reference image. A frame corresponding to each of the specific motion points is extracted to display the image.

An image at an impact time is important for diagnosing the golf swing. The position before the impact time, namely, the take-back and the neighborhood of the switch-over from the top position to the downswing and the position after the impact time are particularly important for diagnosing the golf swing. This is because the swing form cannot be corrected at the impact time, if the golfer has an improper swing in the neighborhood of the impact time. To examine the cause of the improper swing form at the impact time, it is necessary to extract a plurality of images of to-be-checked swing postures from images of the take-back time and in the neighborhood of the top position. Thereby it is possible to diagnose the swing form by taking many to-be-checked points of the swing posture in consideration.

However, in the swing form diagnosis apparatus disclosed in Japanese Patent Application Laid-Open No. 2003-117045, images at the take-back time are extracted by merely executing the differential processing between frames. Thus there is a high possibility that an image of a different position is erroneously extracted for a golfer. An image in which the shaft is horizontal at the take-back time is extracted by regarding the frame having a minimum in the X-direction deviation amount in the result of the differential processing as the frame to be extracted. However, golfers' vertical and horizontal motions during a swing are quite different from each other. Thus in the case of a golfer having a take-back while the golfer is swaying (moves horizontally), a horizontal image of the shaft is extracted at a low degree of accuracy by merely considering the X-direction deviation amount during the take-back.

In the extraction of images at the downswing time and the follow-through time, frames a predetermined period of time before and after the impact-time image which is the reference-point image are extracted. Considering that golfers' swing tempos are quite different from each other, it is impossible to extract an image of the same swing position (swing posture) for a plurality of golfers. Thus even if a golfer intends to improve her/his swing form at the time when the golf club shaft is horizontal by comparing her/his swing form with a swing form of a high-class player or that of a professional player, there is no guarantee that the extracted image of her/his swing form is the image at the time when the golf club shaft is horizontal. Therefore it is impossible to compare her/his swing form with that of the high-class player or that of the professional player in the same swing position (posture).

SUMMARY OF THE INVENTION

The present invention has been made in view of the above-described problems. Therefore it is an object of the present invention to provide a system of capable of precisely extracting still images of a swing position effective for diagnosing a golf swing from a moving image of a photographed golf swing.

To solve the above-described problems, in the first invention, there is provided a golf swing diagnosis system including a computer for capturing a colored moving image obtained by photographing a golfer who swings by gripping a golf club having colored marks attached to a shaft thereof. The computer has a means for converting the colored moving image into a plurality of still images; a means for executing binarization for each pixel of a plurality of the still images by using a specific threshold of color information and recognizing pixels, of the still images, which satisfy the threshold as positions of the colored marks so as to obtain coordinate data of each of the colored marks; an operation extraction means for recognizing a movement of the golf club shaft by using a movement vector amount of one of the colored marks computed based on the coordinate data of each of the colored marks or by using a vector angle between two of the colored marks; an image extraction means for selectively extracting still images necessary for diagnosing a golf swing from a plurality of the still images, based on data obtained by the operation extraction means; and an output means for outputting the extracted still image.

In the above-described construction, binarization is executed for the color information such as hue, saturation, and lightness by using the specific threshold corresponding to the color of each of the colored marks. Thereby it is possible to automatically recognize the pixel corresponding to each of the colored marks of the still image. Thus with reference to the movement vector amount of the colored mark computed based on the coordinate data of the colored marks or with reference to the vector angle between two of the colored marks attached to the golf club shaft, it is possible to recognize the swing motion and selectively extract a still image useful for diagnosing the golf swing from a plurality of the still images. The extracted still image useful for diagnosing the golf swing is outputted to a computer through a network or the like so that it is displayed on its display screen, printed, stored by an external recording medium. Thereby it is possible for a professional player (teacher) and a golfer to diagnose the golf swing by observing output results.

The area range regarded as the colored mark is set in an image in advance so that when the number of aggregates of pixels satisfying the binarized threshold is more than that of the colored marks, the aggregates of pixels falling in the set area range should be decided as the colored mark. Further by executing the differential processing between the colored mark and the background image, the processing of deciding the colored mark may be executed based on the area range after a region in which the colored mark is not present is cut.

It is preferable that the golf swing diagnosis system has a photographing means for photographing a golfer who swings by gripping the golf club shaft to which the colored marks are attached, thus providing a colored moving image.

It is preferable that the extracted still images necessary for diagnosing the golf swing are check-point images including an impact image and one or more swing postures other than the impact image.

The operation extraction means automatically traces a position of each of the colored marks of each still image by storing automatically recognized color information of red, green, and blue of each of the colored marks of one still image as reference color information; sets an allowable range of a color regarded as the same color as the reference color; sets on a subsequent frame a search range which is a region including an estimated position of each of the colored marks in a still image of the subsequent frame adjacent to the one still image in time series; and regards pixels falling in the color range as the positions of the colored marks in the search range.

The automatic tracing can be executed by the binarization or in combination of the color range and the binarization in addition to the method of using the color range.

In the above-described construction, to detect the position of each of the colored marks, whether a region falls within the color range is judged not in the entire screen but only in the search range. Therefore when the still image includes a color proximate to that of the colored mark, it is possible to eliminate the color, prevent an erroneous recognition, and shorten a computing period of time.

Differential processing is executed between the pixel within the search range of the still image and the background image to eliminate the background image. Thereby even if the background image includes the color proximate to that of the colored mark, it is possible to eliminate the color and prevent the erroneous recognition to a higher extent. The erroneous recognition can be prevented by carrying out a method in which the size of the area of the colored mark and the shape of the colored mark are considered.

When the colored marks cannot be traced, binarization is executed again on each pixel in the search range by using the specific threshold of the color information to obtain coordinate data by regarding pixels satisfying the threshold as the positions of the colored marks.

In the above-described construction, even if there is a still image in which tracing of the colored marks have failed, it is possible to obtain the coordinate data of the colored marks by executing binarization again.

The operation extraction means extracts a swing posture by using a movement vector amount between still images, of one of the colored marks provided on the shaft, adjacent to each other in time series. The image extraction means extracts a still image at an impact time and one or more images of a swing posture selected from among a take-back shaft 9 o'clock image, a top image, a downswing shaft 9 o'clock image, a follow-through shaft 3 o'clock image, and a finish image as check-point images.

In the above-described construction, a frame in which a Y-direction component of the movement vector amount of one colored mark is minimum is regarded as the impact image, and a frame in which an X-direction component of the movement vector amount of the colored mark is minimum is regarded as the take-back shaft 9 o'clock image. Thereby it is possible to selectively and automatically extract each check-point image useful for diagnosing the swing. It is to be noted that the longitudinal direction in the image is set as the Y-direction and that the lateral direction therein is set as the X-direction.

The operation extraction means extracts a swing posture by using a vector angle between two or more of the colored marks provided on the shaft at certain intervals or/and a movement vector amount of one of the colored marks near a grip. The image extraction means extracts a still image at an impact time and one or more images of a swing posture selected from among a take-back shaft 9 o'clock image, a top image, a downswing shaft 9 o'clock image, a follow-through shaft 3 o'clock image, and a finish image as check-point images.

In the above-described construction, a frame in which the vector angle is 90 degrees (horizontal) is regarded as the take-back shaft 9 o'clock image, and a frame in which the vector angle is 0 degree (vertical) is regarded as the impact image. Thereby it is possible to selectively and automatically extract each check-point image useful for diagnosing the swing.

The operation extraction means executes differential processing of the still image by using a background image in which a golfer is not photographed to obtain a golfer's silhouette; extracts a contour of the silhouette; regards a pixel which makes a curvature of the contour extreme as an unskillful arm side shoulder; computes a position of the grip from a positional relationship between two of the colored marks; stores at least one part of the still image in a range from the shoulder at the unskillful arm side to the grip as a template; and extracts a movement of a golfer's unskillful arm by executing template matching processing for a still image during a take-back swing. The image extraction means regards a frame of the still image in which the template has become horizontal as an image in which the unskillful arm is horizontal in the take-back swing, based on data obtained by the operation extraction means, thus extracting the still image as a check-point image. It is possible to execute the matching processing at the template angle in which starts the template matching processing without extracting silhouette from the angle as prescribed and memorized.

In the above-described construction, it is possible to recognize the angle of the matched template by template matching processing as the angle of the unskillful arm and automatically extract an image in which the golfer's unskillful arm at the take-back time is horizontal. If there are two or more golfer's silhouettes as a result of execution of the background subtraction between the still image and the background image, i.e., if another silhouette is erroneously extracted in addition to an actual silhouette, it is preferable to set an area range of the image which is considered the golfer's silhouette in advance to determine a silhouette disposed in the area range as the golfer's silhouette.

The image extraction means stores at least one part of the images in the range from the shoulder to the grip in the still image in which the unskillful arm is horizontal in the take-back swing as a template; and executes template matching processing for the still image in a downswing and regards a frame of an image that matches the template to a highest extent as the still image in which the unskillful arm is horizontal in the downswing, thus extracting the image that matches the template to the highest extent as a check-point image.

That is, by utilizing the fact that the unskillful arm which is horizontal at the take-back time and the unskillful arm which is horizontal at the downswing time have almost the same state, the image extraction means stores at least one part of images in the range from the shoulder to the grip in the still image in which the unskillful arm is horizontal in the take-back swing as the template and executes the template matching processing for the still image in the downswing by using the template. Thereby it is possible to automatically extract the frame of the image in which the unskillful arm is horizontal in the downswing.

The image extraction means executes differential processing for the still image by using a background image in which a golfer is not photographed to obtain the golfer's silhouette and obtain one end of the silhouette as a side of a golfer's leg at the skillful arm side from a left-to-right width of the silhouette; and regards an image at a time when a perpendicular passing through the side of the leg at the skillful arm side intersects with the colored mark attached to the shaft as a take-back shaft 8 o'clock image, thus extracting the take-back shaft 8 o'clock image as a check-point image. The perpendicular may not be automatically extracted but a line stored in advance may be set as the perpendicular. A tester may be requested to take a stance by placing her/his skillful leg at a fixed position. Thereby the perpendicular to the skillful leg can be fixed without executing image processing.

In the above-described construction, by merely using the golfer's silhouette and the coordinate data of each colored mark after the differential processing is executed, the take-back shaft 8 o'clock image can be automatically extracted.

The image extraction means regards a photographed first swing image as an address image or regards a still image in which a differential is minimum when differential processing is executed between frames from a start time of an extraction of the swing images as the address image, thus extracting the address image as a check-point image.

In the above-described construction, the image at the address which is the most important position in the golf swing can be automatically extracted. When a sound generated at an impact time and a signal outputted from an impact sensor are obtained as a trigger signal and when a moving image a predetermined period of time before and after the impact time is obtained, the first image is not necessarily the address image. Thus in this case, differential processing is executed between frames. A frame having a minimum differential is considered the state in which the golfer is stationary and regarded as the address image.

In the second invention, there is provided a golf swing diagnosis system including a computer for capturing a colored moving image obtained by photographing a golfer who swings by gripping a golf club having colored marks attached to a shaft thereof. The computer has a means for converting the colored moving image into a plurality of still images;

a means for executing binarization for each pixel of a plurality of the still images by using a specific threshold of color information and recognizing pixels, of the still images, which satisfy the threshold as a position of each of the colored marks so as to obtain coordinate data of each of the colored marks;

an operation extraction means for executing differential processing of the still image by using a background image in which a golfer is not photographed to obtain a golfer's silhouette; extracting a contour of the silhouette; regarding a pixel which makes a curvature of the contour extreme as an unskillful arm side shoulder; computing a position of the grip from a positional relationship between two of the colored marks; storing at least one part of images in a range from the shoulder at the unskillful arm side to the grip as a template; and extracting a movement of a golfer's unskillful arm by executing template matching processing for a still image during a take-back swing; and an image extraction means for regarding a frame of the still image in which the template has become horizontal as an image in which the unskillful arm is horizontal in the take-back swing, based on data obtained by the operation extraction means, thus extracting the still image as a check-point image.

It is preferable that the golf swing diagnosis system has a photographing means for photographing a golfer who swings by gripping the golf club shaft to which the colored marks are attached, thus providing a colored moving image.

The image extraction means stores at least one part of the images in the range from the shoulder to the grip in the still image in which the unskillful arm is horizontal in the take-back swing as a template; and executes template matching processing for the still image in a downswing and regards a frame of an image that matches the template to a highest extent as the still image in which the unskillful arm is horizontal in the downswing, thus extracting the image that matches the template to the highest extent as a check-point image.

When recognition of the colored marks has failed in executing binarization for pixels of each of the still images by using a specific threshold of color information, of a plurality of the still images constructing the color moving image, differential processing is executed between a pair of still images spaced at a certain time interval so as to regard one of the still images in which the number of pixels whose norm is larger than a predetermined threshold becomes a minimum value as a top image and extract the top image as a check-point image.

That is, the top posture during the golf swing is a stop posture at which the take-back switches to the downswing. Thus differential processing is executed at different times between a pair of still images spaced at certain time intervals so as to specify a still image in which the number of pixels whose norm is larger than the predetermined threshold becomes a minimum value. Thereby the top image can be extracted.

The above-described norm is known and means the square root of the sum of the squares of absolute values of the difference between the value of red of a pixel of one image and that of red of a corresponding pixel of the other image, the difference between the value of green of the pixel of the one image and that of green of the corresponding pixel of the other image, and the difference between the value of blue of the pixel of the one image and that of blue of the corresponding pixel of the other image (see equation 7).

When recognition of the colored marks has failed, an extraction of a downswing shaft 9 o'clock image has failed, and an extraction of a take-back shaft 9 o'clock image has succeeded in executing binarization for pixels of each of the still images by using a specific threshold of color information, a search range is set on the still image by setting a coordinate of a position of each of the colored marks in the take-back shaft 9 o'clock image as a reference, and an allowable color range regarded as the same color as that of each of the colored marks is set on the still image; a pixel falling in the color range is regarded as a position of each of the colored marks in the search range so as to recognize the coordinate of the position of each of the colored marks in the take-back shaft 9 o'clock image; and an image in which a vector between two or more of the colored marks is most horizontal is regarded as the downswing shaft 9 o'clock image so as to extract the downswing shaft 9 o'clock image as a check-point image.

That is, the swing motion is a reciprocating motion of the take-back and the downswing. The position of the golf club shaft in the take-back shaft 9 o'clock image is proximate to that of the golf club shaft in the downswing shaft 9 o'clock image. Thus when the extraction of the take-back shaft 9 o'clock image has succeeded, the search range is set by setting the colored marks in the take-back shaft 9 o'clock image as the reference. Thereby it is possible to extract each of the colored marks in the downswing shaft 9 o'clock image.

A search range having a predetermined area is set on a periphery of a ball in a still image; and differential processing is executed between a pair of still images spaced at a certain time interval so as to regard a still image at a time when the number of pixels whose norm value is larger than a predetermined threshold starts to increase or at a time when the number of the pixels whose norm value is larger than the predetermined threshold exceeds another threshold as an impact image so as to extract the impact image as a check-point image.

That is, in the golfer's posture at an impact time during the golf swing, the golf club head hits a ball. Thus in the search range of the still image set on the periphery of the ball, differential processing is executed at different times between a pair of still images spaced at certain time intervals so as to specify a still image at a time when the number of pixels whose norm value is larger than a predetermined threshold starts to increase or at a time when the number of the pixels whose norm value is larger than the predetermined threshold exceeds another threshold. Thereby the impact image can be extracted.

A detection sensor that detects a passage of a golf club is provided in the vicinity of a ball so that based on a trigger signal outputted from the detection sensor, an impact image is extracted from a plurality of the still images.

In the above-described construction, it is possible to estimate the position of the golf club head when the detection sensor detects the passage of the golf club provided in the vicinity of the ball. Therefore the impact image can be extracted without executing image processing.

Alternatively a sound collection means connected with a computer is provided so that based on a sound generated when the golf club hits the ball, an impact image is extracted from a plurality of the still images.

In the above-described construction, it is possible to specify an image at the time when a sound generated owing to a collision between the golf club head and the ball is detected as the impact image.

An allowable range of a color regarded as the same color as that of a golfer 11's skin is set. A skin extraction is executed by regarding a pixel falling in the color range of the pixel-color information in a plurality of the still images as a golfer 11's skin-color range. Binarization is not executed for the skin-color range in an assumption that the colored marks are not present in the skin-color range.

This construction reliably prevents the golfer's skin color from being erroneously recognized as the color of the colored mark.

In the third invention, there is provided a golf swing diagnosis system including a computer for capturing a colored moving image obtained by photographing a golfer who swings by gripping a golf club having colored marks attached to a shaft thereof. The computer has a means for converting the colored moving image into a plurality of still images;

an image extraction means for executing differential processing for the still image by using a background image in which a golfer is not photographed to obtain the golfer's silhouette and obtain one end of the silhouette as a side of a golfer's leg at the skillful arm side from a left-to-right width of the silhouette; and regarding an image at a time when a perpendicular passing through the side of the leg at the skillful arm side intersects with the colored mark attached to the shaft as a take-back shaft 8 o'clock image, thus extracting the take-back shaft 8 o'clock image as a check-point image; and an output means for outputting the extracted still image.

In the fourth invention, there is provided a golf swing diagnosis system comprising a computer for capturing a colored moving image obtained by photographing a golfer who swings by gripping a golf club having colored marks attached to a shaft thereof. The computer has a means for converting the colored moving image into a plurality of still images; an image extraction means for regarding a photographed first swing image as an address image or regarding a still image in which a differential is minimum when differential processing is executed between frames from a start time of an extraction of the swing images as the address image, thus extracting the take-back shaft 8 o'clock image as a check-point image; and an output means for outputting the extracted still image.

It is preferable that the golf swing diagnosis system has a photographing means for photographing a golfer who swings by gripping the golf club shaft to which the colored marks are attached, thus providing a colored moving image.

As apparent from the foregoing description, in the present invention, binarization is executed for the color information such as hue, saturation, and lightness by using the specific threshold corresponding to the color of each of the colored marks. Thereby it is possible to automatically recognize the pixel corresponding to each of the colored marks of the still image. Thus based on the movement vector amount of one colored mark computed or/and the vector angle between two of the colored marks, it is possible to automatically extract not only impact images but also important images of the swing posture useful for diagnosing the golf swing posture as the check-point images. In the case a swing posture which is difficult to be automatically extracted by only the coordinate data of the colored mark, the template matching processing us utilized to obtain the angle of the golfer's unskillful arm. Thereby such a swing posture can be automatically extracted as the check-point image.

DETAILED DESCRIPTION OF THE PREFERRED EMBODIMENTS

The embodiments of the present invention will be described below with reference to drawings.

Figure 1:
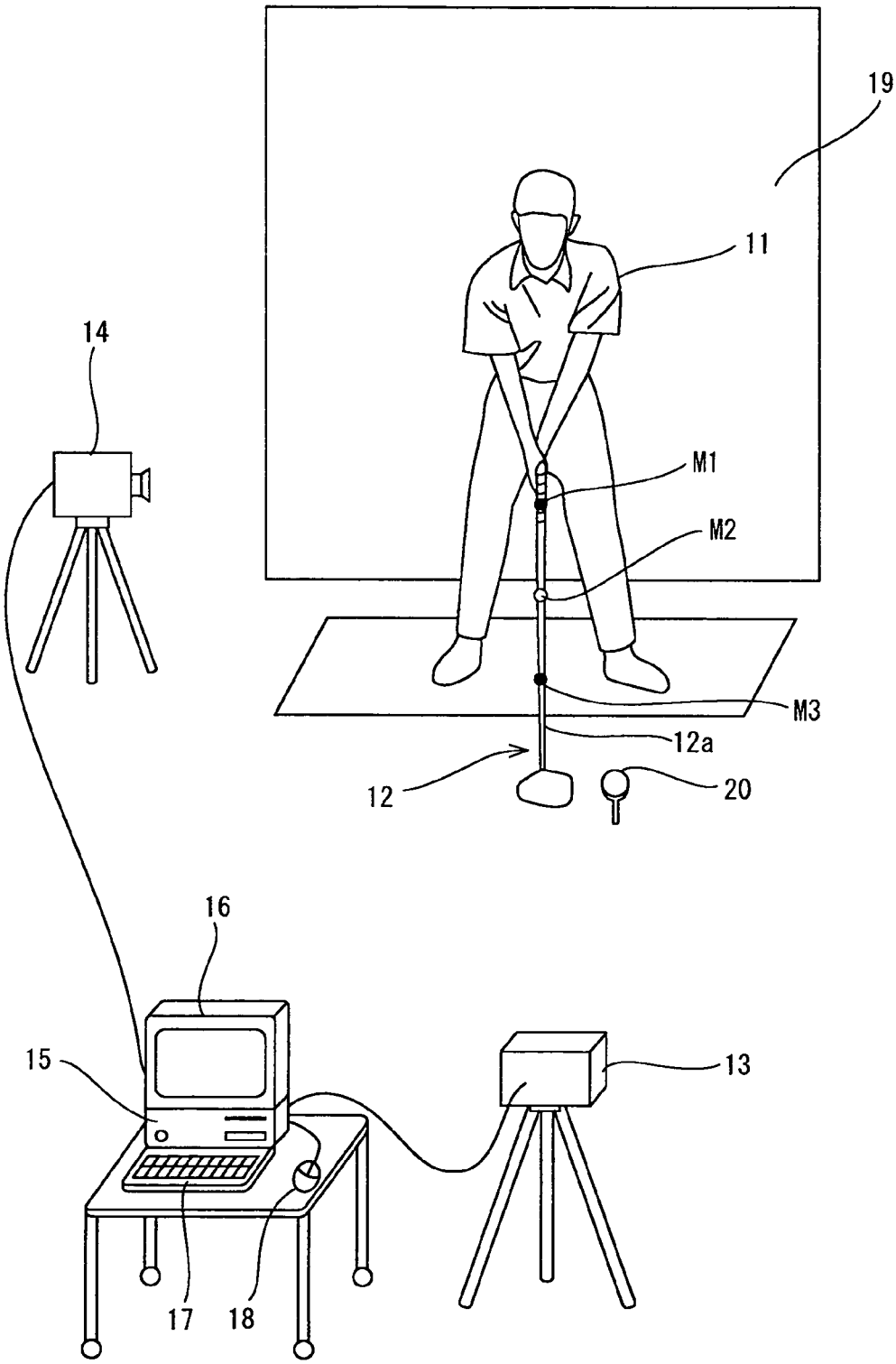
FIG. 1 shows the construction of a golf swing diagnosis system of an embodiment of the present invention.

FIG. 1 shows a schematic view of the golf swing diagnosis system. The golf swing diagnosis system has a computer 15 serving as an information-processing apparatus; a monitor 16 serving as a display means connected to the computer 15; a key board 17 and a mouse 18, serving as input means, connected to the computer 15; and color CCD cameras 13 and 14, connected to the computer 15, installed at a position forward from a golfer 15 and at a position rearward from the golfer 15 in a ball fly line respectively. Three color marks M1, M2, M3 are mounted on required positions of a shaft 12*a* of a club 12 gripped by the golfer 11 to be diagnosed by spacing the color marks M1, M2, M3 at certain intervals.

The color marks M1 through M3 are mounted on the shaft 12*a* at equal intervals from a grip side to a head side. The colored mark M1 nearest to the grip is yellow. The colored mark M2 disposed between the colored marks M1 and M3 is pink. The colored mark M3 disposed at the head side is yellow. That is, the adjacent color marks have different colors. In this embodiment, the distance between the adjacent color marks is set to 250 mm. The distance between the grip end and the colored mark M1 is set to 250 mm.

The computer 15 synchronizes the photographing timing of the color CCD cameras 13 and 14 with each other. When an analog CCD camera is used, each of the color CCD cameras 13 and 14 has not less than 30 frames and favorably not less than 60 frames per second. When a high-speed digital CCD camera is used, each of the color CCD cameras 13 and 14 has not less than 60 frames and favorably not less than 120 frames per second. When a general-purpose CCD video camera is used, each of the color CCD cameras 13 and 14 has not less than 30 frames per second. The shutter speed is set to not more than 1/500s and favorably not more than 1/1000s.

It is necessary to set the brightness of a space (3 m (length)×3 m (width)×2 m (height)) in which a golfer's swing is photographed to not less than 1000 luces. If an extremely bright portion is generated in the space, there is a possibility that halation is generated. Therefore as the brightness of the environment in which the golfer swings, it is preferable to set a uniform brightness in the range of not more than 3000 luces. It is preferable that a background 19 of the space in which the swing is photographed has a color different from the color of the clothes of the golfer and that of the color marks M1 through M3 so that the color marks M1 through M3 can be extracted easily.

The computer 15 is online with the color CCD cameras 13, 14 through a LAN cable, an IEEE1394 or a Camera Link Standard. A moving image (a plurality of still images) of the swing photographed by the color CCD cameras 13, 14 are stored in the hard disk of the computer 15, a memory of the computer 15 or the memory of the board thereof. Images may be captured into the computer later by an off-line by utilizing a recording medium such as a DV tape. As will be described later, the computer 15 has a program having a means for executing binarization for each pixel of a plurality of the still images by using a specific threshold of color information and recognizing pixels, of the still images, which satisfy the threshold as a position of each of the colored marks M1 through M3 so as to obtain coordinate data of each of the colored marks M1 through M3; an operation extraction means for recognizing the movement of the shaft 12*a*, based on the coordinate data of the colored marks M1 through M3; and an image extraction means for selectively extracting still images necessary for diagnosing the golf swing, based on data obtained by the operation extraction means.

Figure 10:
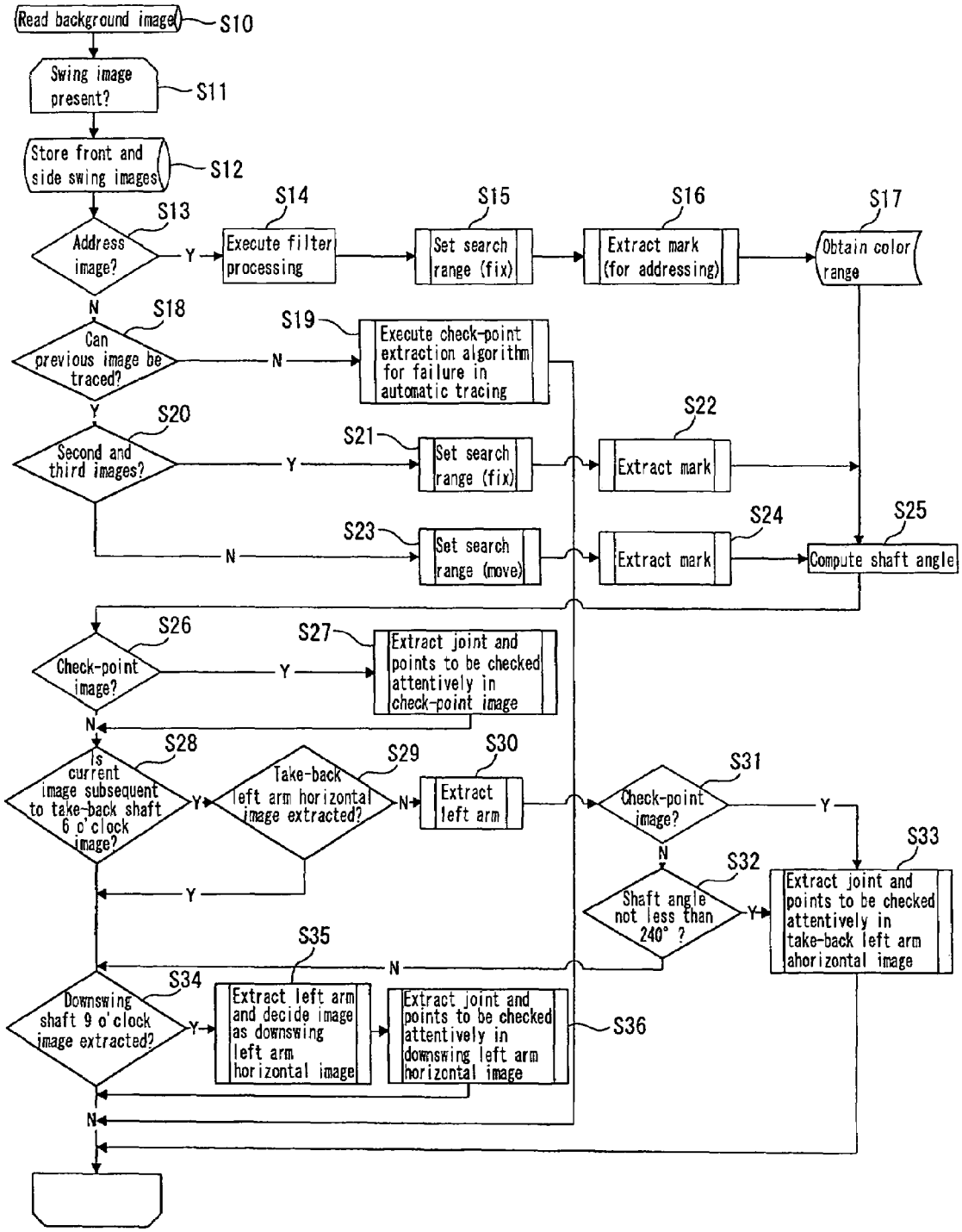
FIG. 10 is a flowchart showing the outline of a swing diagnosis.

With reference to the flowchart of FIG. 10, description is made on the procedure of tracing the coordinate of each of the color marks M1 through M3 attached to the shaft 12*a* from the moving image of the swing captured into the computer 15 through the color CCD cameras 13, 14.

Initially, a background image in which only the background 19 is photographed by the color CCD cameras 13, 14 is read (step S10). The moving image of the swing is captured into the computer 15 through the color CCD cameras 13, 14 (step S11). The moving image is converted into the still image for each frame. The data of each obtained still image is stored in the hard disk. Each of a front still image and a side still image of the golfer's swing from the addressing state till the finish state is stored in the memory (step S12). To store high-quality images, a BMP format is preferable as the image-storing format. In addition, other file formats such as JPEG, TIFF, and the like may be adopted.

Thereafter the following check-point images useful for diagnosing the swing are automatically extracted from a large number of still images constituting the moving image of the swing: an address image, a take-back shaft 8 o'clock image, a take-back shaft 9 o'clock image, a take-back left arm horizontal image, a top image, a downswing left arm horizontal image, a downswing shaft 9 o'clock image, an image previous to impact image, an impact image, an image subsequent to impact image, a follow-through shaft 3 o'clock image, and a finish image.

The reason the extraction of the above-described check-point images is necessary is as follows: It depends on the orbit of the golfer's swing and the angle of the golf club face at an impact time that a ball hit by the golfer slices or hooks. Thus to examine what causes the golfer to have the swing orbit and the angle of the golf club face at the impact time, it is necessary to check the image of the swing at each of the positions by paying attention to the swing orbit, the orientation of the golf club face, the golfer's posture during the swing, and the golfer's grip. The check-point image is not limited to the images of the above-described swing postures. Needless to say, it is favorable to increase or decrease the number of the check-point swing postures as necessary.

The method of automatically extracting each check-point image is described below.

Address Image

Initially, the method of extracting the address image is described below. The address image means a still image in the state in which the golfer 11 takes an address posture.

When photographing of the moving image of the swing starts from the address state, an initial image is set as the address image. When a sound generated at the impact time and a signal outputted from an impact sensor are obtained as a trigger signal and when the moving image in a predetermined period of time before and after the impact time is obtained, the initial image is not necessarily the address image. This is because the initial image includes the image of a waggle (operation of swinging golf club head as a preparatory operation before addressing ball). Thus in this case, background subtraction is executed between frames (still images). A frame having a minimum differential is regarded as the state in which the golfer 11 is stationary and regarded as the address image (step S13).

Thereafter the method of extracting the take-back shaft 9 o'clock image, the top image, the downswing shaft 9 o'clock image, the image previous to impact image, the impact image, the image subsequent to impact image, the follow-through shaft 3 o'clock image, and the finish image is described below.

The take-back shaft 9 o'clock image means a still image which is placed at a nine o'clock position at a take-back time, when the shaft is regarded as the needle of a clock. The top image is a still image placed at a top position at which the swing shifts from a take-back to a downswing. The downswing shaft 9 o'clock image means a still image placed at the nine o'clock position in the downswing, when the shaft is regarded as the needle of the clock. The image previous to impact image means a still image in a state immediately before the golf club head impacts the ball. The impact image means a still image at the time when the golf club head collides with the ball. The image subsequent to impact image means a still image in a state immediately after the golf club head impacts the ball. The follow-through shaft 3 o'clock image means a still image placed at the three o'clock position at a follow-through time when the shaft is regarded as the needle of the clock. The finish image means a still image when the swing has finished and the golf club stops moving.

Basically, the swing posture shown on each the check-point image is judged by tracing the coordinates of the colored marks M1 through M3 of each frame. Thus initially, the method of automatically tracing the colored marks M1 through M3 is described below.

Binarization for automatically recognizing the colored marks M1 through M3 is executed in the address image.

It is preferable to reduce noise and blurring of the image by executing known median filter processing at this time (step S14). That is, when gradation values of nine pixels in a mask of 3×3 pixels are arranged in the order from a small gradation value to a large gradation value (or from a large gradation value to a small gradation value), a fifth tone value (central value) is smoothed as a central pixel value in the mask to thereby reduce noise and blurring.

Figure 2:
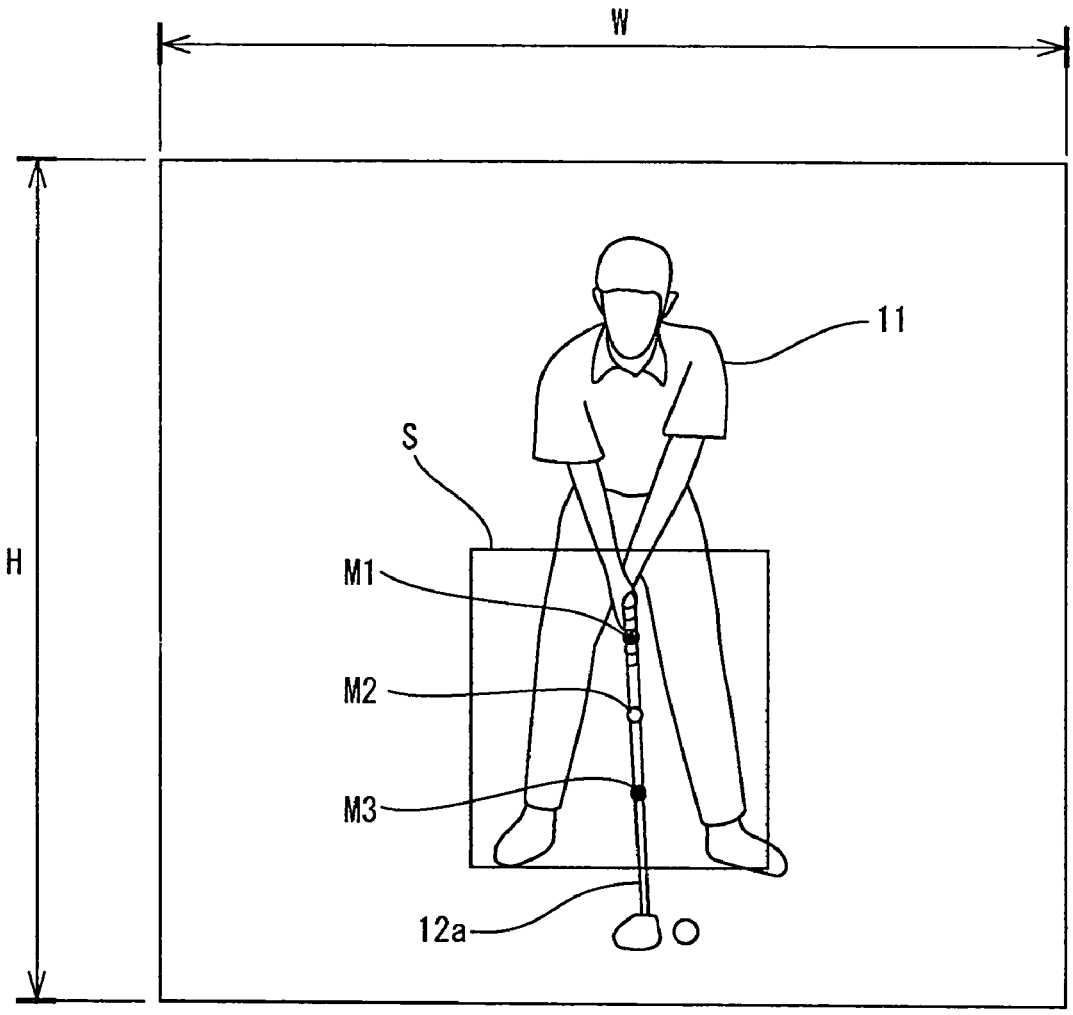
FIG. 2 is an explanatory view for explaining extraction of colored marks in an address image.

The binarization is executed for the entire frame in this embodiment. But the binarization may be executed for only a region S in which the golf shaft 12*a* is considered present, when the region to be photographed is so limited that the golfer 11 is photographed in the vicinity of the center of the image (step S15), as shown in FIG. 2. Supposing that the width of the image is W and that the height thereof is H, the range of W/3 to 2W/3 is set as the width of the region S, and the range of H/2 to 4H/5 is set as the height of the region S.

As the method of executing the binarization, the value of RGB or YIQ may be used. In this embodiment, hue, saturation, lightness which allow the color of the colored marks M1 through M3 to be recognized to the highest extent are utilized. The binarization is executed as follows: Initially, the RGB value of each pixel on the frame is obtained.

$$T=R+G+B \qquad \text{Equation 1}$$

Normalization of an equation 2 shown below is performed by using a stimulus sum T determined by the equation (1).

$$r=\frac{R}{T},\ g=\frac{G}{T},\ b=\frac{B}{T} \qquad \text{Equation 2}$$

When the color is expressed in 24 bits, the value of the RGB is in the range of 0 to 255.

The hue θ is computed by using equations 3 and 4 shown below.

$$\theta_1=\cos^{-1}\frac{2r-g-b}{\sqrt{6[(r-1/3)^2+(g-1/3)^2+(b-1/3)^2]}} \qquad \text{Equation 3}$$

Because $0 \leqq \theta_1 \leqq \pi$, an equation 4 is as shown below:

$$\theta=\begin{cases}\theta_1 & g \geq b\\ 2\pi-\theta_1 & g<b\end{cases} \qquad \text{Equation 4}$$

The saturation S is computed by using an equation 5 shown below.

$$S=1-3\min(r,g,b) \qquad \text{Equation 5}$$

The lightness V is computed by using an equation 6 shown below.

$$U=\frac{R+G+B}{3} \qquad \text{Equation 6}$$

When the value of the hue, saturation, lightness of a pixel (color information of pixel) obtained by using the equations 3 through 6 does not satisfy a predetermined condition (reference color information), the pixel is set to 0. When the value of the hue, saturation, lightness of the pixel satisfies the predetermined condition, the pixel is regarded as having the same color as that of the colored marks M1 through M3 and set to 1, and labeling processing of pixels set to 1 is executed sequentially (step S16).

As the predetermined condition of the hue, the saturation, and the lightness, a threshold having the hue θ=30° to 60°, the saturation S≧0.5, and the lightness V≧100 is set for the yellow colored marks M1, M3. A threshold having the hue θ=320° to 360° or 0° to 10°, the saturation S=0.3 to 0.6, and the lightness V≧80 is set for the pink colored mark M2. Pixels satisfying these predetermined conditions are regarded as having the same color as that of the colored marks M1, M3. There is a possibility that a color recognized by the color CCD cameras 13, 14 varies to some extent in dependence on environment in which the swing is photographed or in dependence on the characteristic of a camera. Thus in deciding the threshold having the hue, saturation, lightness, it is preferable to photograph the colored marks M1 through M3 in the same condition to obtain the color information of the colored marks M1 through M3.

There is actually only one pink colored mark M2. When an unrelevant pink color is present in the image, there is a fear that two or more regions are extracted. In consideration of such a case, the area range of the colored mark M2 is set in advance. A region having an area larger than the set area range is judged as not the colored mark M2, whereas a region having an area smaller than the set area range is recognized as the colored mark M2. In this embodiment, the area range recognized as that of the colored marks M1 through M3 is 5 to 40 pixels or 5 to 200 pixels. When the shape of each of the colored mark M1 through M3 is restricted to a circle, it is possible to add a restriction condition of recognizing only an extracted region whose contour is circular as the colored marks M1 through M3.

When pixels recognized as the colored marks M1 through M3 in the above-described manner are set to 1, 2, and 3 respectively by labeling the colored marks M1 through M3, the color information of the colored mark serving as the reference color information and the coordinate of the center of gravity are obtained from the pixels set to the respective numerical values. The color information of the colored mark means the information of a color range including an average color of pixels in the region, maximum and minimum values of the RGB of each pixel, and the fluctuation width thereof (step S17).

By executing the above-described processing, it is possible to automatically and precisely extract the colored marks M1 through M3 attached to the shaft 12*a* of the golf club 12.

Thereafter the position-of each of the colored marks M1 through M3 is traced for images other than the address image. At this time, a second search routine of "check-point extraction algorithm for failure in automatic tracing" which will be described later is executed (step S19), if a failure has occurred in recognizing all of the colored marks M1 through M3 in an image at one unit time previous to a current time or if a failure continues by three frames in recognizing two of the three colored marks M1 through M3 (step S18).

The positional relationship among the colored marks M1 through M3 at the one unit time previous to the current time is examined. The second search routine of "check-point extraction algorithm for failure in automatic tracing" should be executed when the angle between a vector (M2-M3) vector and a vector (M1-M2) is not more than 170° or the angle between the vector (M1-M2) and a vector (M1-grip) is not more than 170°. This is because there is a high possibility that colored marks other than the colored marks M1 through M3 is erroneously recognized as the colored marks M1 through M3.

Processing of automatically tracing the colored marks M1 through M3 extracted automatically in the address image is executed for second and third images after the address image is obtained (step S20).

Figure 3:
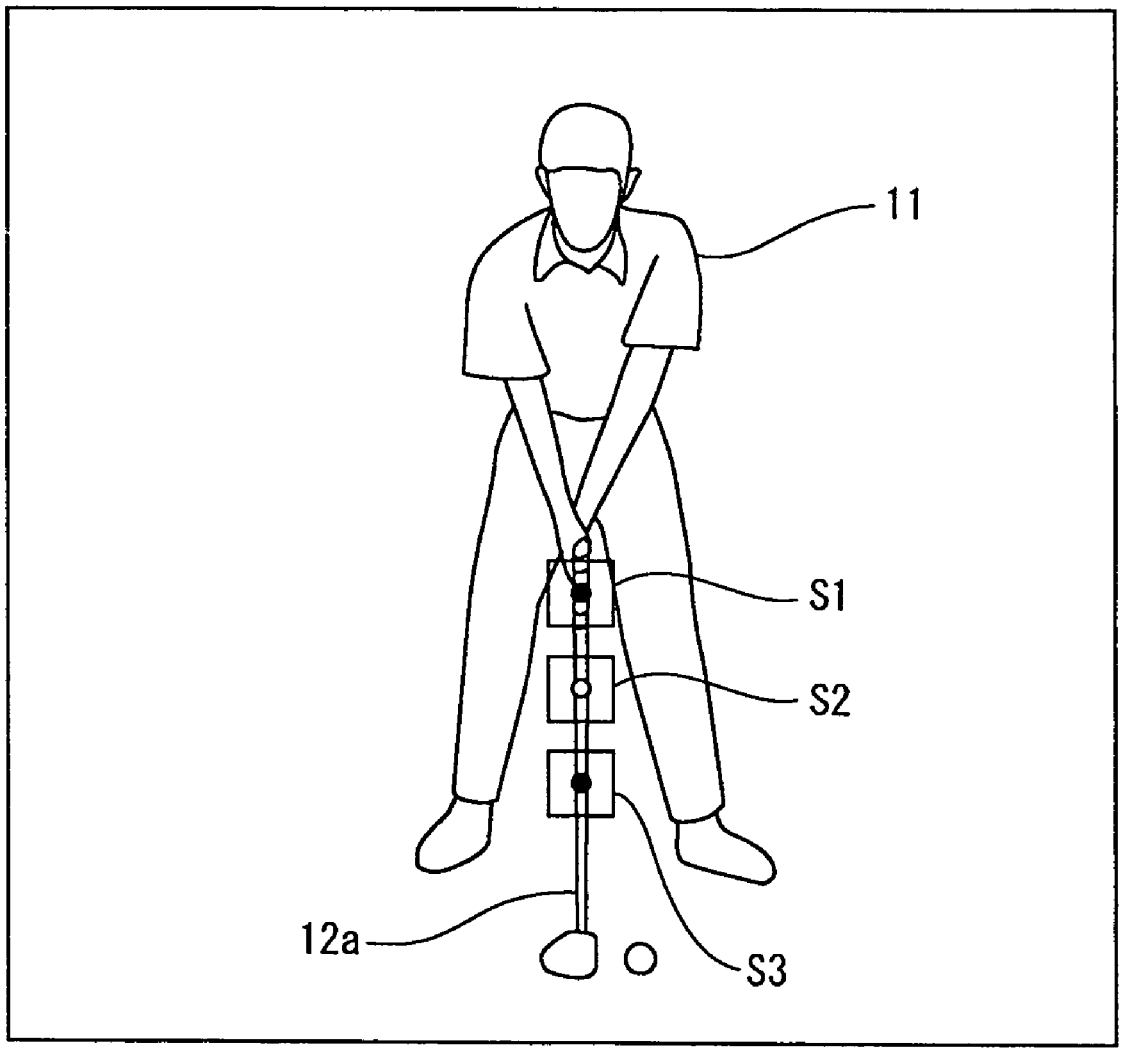
FIG. 3 is an explanatory view for explaining extraction of colored marks in second and third images subsequent to the address image.

Square search ranges S1 through S3 are set on the colored marks M1 through M3 respectively, with the colored marks M1 through M3 disposed at the center thereof (step S21). The search ranges S1 through S3 mean the range of the image in which computations are performed to execute processing of detecting the colored marks M1 through M3. By introducing the concept of the search ranges S1 through S3, the processing of detecting the colored marks M1 through M3 is executed only within the search ranges S1 through S3, even if there is a portion having a color proximate to that of the colored marks M1 through M3 outside the search ranges S1 through S3. Therefore it is possible to prevent the portion from being erroneously recognized as the colored marks M1 through M3 and make a computing period of time much shorter than that required in the case where binarization is performed for all pixels. In this embodiment, in the search ranges S1 through S3, by default, a length×breadth (YX) range is set to 10×10 pixels with the colored marks M1 through M3 disposed at the center of the search ranges S1 through S3 respectively, as shown in FIG. 3. The breadth of the image direction is set as an X-axis, and the length direction thereof is set as a Y-axis. The shaft 12*a* hardly moves in the second image and the third image after the address image is obtained. Thus the search ranges S1 through S3 during the automatic tracing is determined by setting the colored marks M1 through M3 automatically recognized in the image one unit time previous to the current time as the central position of the search ranges S1 through S3 respectively.

Thereafter the color range is set.

The color range means an error-allowable range in which the color information of pixels of the image to be processed is the same as that of the colored marks M1 through M3 in recognizing the colored marks M1 through M3. In this embodiment, the numerical range of the half of the difference between a maximum width and a minimum width is set as the color range in which an average value of each of R (red), G (green), and B (blue) which are the color information of the colored marks M1 through M3 obtained in the address image is disposed at the center of the color range.

The automatic tracing processing is executed by tracing the colored marks M1 through M3 sequentially from the colored mark M1, disposed nearest the grip, which moves at a speed lower than the other colored marks M2 and M3 during the swing to the colored mark M2 and then to the colored mark M3.

Initially, inside the search range S1, differential processing is executed between the colored mark M1 and the background image. Thereby the background image is removed from the search range S1. Thus even though a color proximate to that of the colored mark M1 is present in the background image, the color is not erroneously recognized as that of the colored mark M1 in subsequent steps.

It is possible to select the search ranges S1 through S3 for which the differential processing is executed. The differential processing may be executed for all the search ranges S1 through S3 or may not be executed for a range and at a timing where there is little possibility that an erroneous recognition is made between the colored mark M1 and the image of the background 12.

It is judged whether or not each of the RGB of the differential pixel inside the search range S1 falls in the above-described color range. A pixel falling in the color range is regarded as the pixel indicating the colored mark M1, and the position of the center of gravity of the search range S1 is obtained (step S22). If this method of using the color range is incapable of tracing the colored marks, a color extraction may be performed to trace them by utilizing the color information (hue, saturation, lightness). These processing is executed in each of the search ranges S1 through S3 of the colored marks M1 through M3.

Description is made on the method of setting the central position of the search ranges S1 through S3 of the colored marks M1 through M3 in frames subsequent to the fourth frame with respect to the address image. In the case of the colored mark M1 nearest the grip, a movement vector amount V1 between a first frame (address) and a second frame and a movement vector amount V2 between the second frame and a third frame are computed. In consideration of an increase amount V2−V1, a movement vector amount {V2+(V2−V1)} between the third frame and the fourth frame is estimated. A position to which the colored mark M1 is offset by the movement vector amount {V2+(V2−V1)} from the central position of the search range S1 at one unit time previous to the current time is set as the center of the search range S2 of the current-time image (fourth frame) (step S23). Similarly, the colored marks M1 through M3 are extracted by using the color range (step S24). The method of setting the central position of each of the search ranges S1 through S3 of the colored marks M1 through M3 in the fifth frame and those subsequent to the fifth frame is carried out similarly.

The method of setting the central position of each of the search ranges S2 and S3 of the colored marks M2 and M3 in the fourth frame is as follows: The colored marks M2 and M3 are offset from the central position of each of the search ranges S2 and S3 at one unit time previous to the current time by the movement vector amount {V2+(V2−V1)} obtained by utilizing the colored mark M1 whose position has been decided. A shaft angle D1 between the first frame and the second frame and a shaft angle D2 between the second frame and third frame are computed. In consideration of an increase amount D2−D1, a shaft angle {D2+(D2−D1)} between the third frame and the fourth frame is estimated. Each of the colored marks M2 and M3 is rotated on the colored mark M1 of the fourth frame by the shaft angle {D2+(D2−D1)}. The method of setting the central position of each of the search ranges S2 and S3 of the colored marks M2 and M3 in the fifth frame and those subsequent to the fifth frame is carried out similarly.

Figure 4:
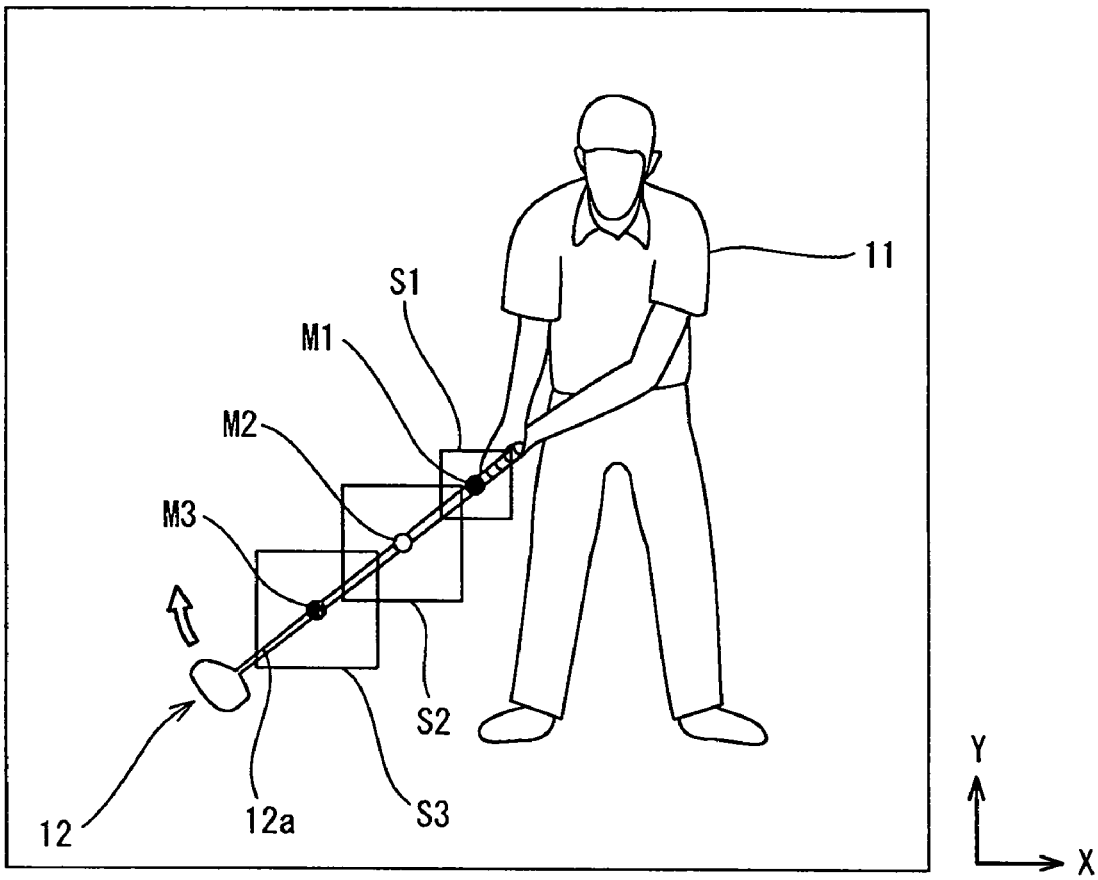
FIG. 4 is an explanatory view for explaining automatic tracing of the colored marks.

By deciding the central position of each of the search ranges S2 and S3 in combination of the offset movement and the rotation movement, it is possible to estimate the position of the shaft 12*a* considerably accurately, even when the shaft 12*a* moves fast in a downswing. Thus it is unnecessary to increase the area of the search ranges S2 and S3 while the positions of the colored marks M1 through M3 are being traced. As shown in FIG. 4, the area of each of the search ranges S2 and S3 is set to 20×20 pixels.

If a plurality of candidate regions of the colored mark is extracted in the search range, the differential processing is executed between the image of the colored mark M1 and the background image inside the search range S1. Thereby the background image is removed from the search range S1. Thus even though a color proximate to that of the colored mark M1 is present in the background image, the color is not erroneously recognized as that of the colored mark M1 in subsequent steps.

When the positions of the colored marks M1 through M3 cannot be traced by the above-described method, binarization is executed again by carrying out a method similar to the method by which the colored marks M1 through M3 are automatically extracted in the address image. That is, as the main conceivable reason the colored marks M1 through M3 cannot be found in the color range determined in the address image, the colored marks M1 through M3 present in a range darker than the address image is traced. Thus alteration of reducing the threshold of the saturation and lightness of the colored marks M1 through M3 is made to execute the binarization again. More specifically, as the predetermined condition of the hue, the saturation, and the lightness, a threshold having the hue $\theta=30°$ to 60°, the saturation $S \geqq 0.4$, and the lightness $V \geqq 80$ is set for the yellow colored marks M1, M3. A threshold having the hue $\theta=320°$ to 360° or 0° to 10°, the saturation $S \geqq 0.1$, and the lightness $V \geqq 80$ is set for the pink colored mark M2. Pixels satisfying these predetermined conditions are regarded as having the same color as that of the colored marks. There is a possibility that a color recognized by the color CCD cameras 13, 14 varies to some extent in dependence on environment in which the swing is photographed or in dependence on the characteristic of a camera. Thus in deciding the threshold having the hue, saturation, lightness, it is preferable to photograph the colored marks M1 through M3 in the same condition to obtain the color information of the colored marks M1 through M3.

When the positions of the colored marks M1 through M3 cannot be still traced and when two of the three colored marks M1 through M3 can be recognized, the position of the remaining one mark is computed from the positional relationship between the two colored marks. Alternatively, the center of the search range in which the colored mark is offset by the above-described method may be regarded as the position thereof at the current time.

The coordinate data of all the colored marks M1 through M3 during the golfer's swing motion from the address till the finish can be obtained in the above-described manner.

The following check-point images are extracted in dependence on the angle of the shaft 12*a* found based on the coordinate data of the colored marks M1 through M3 obtained during the swing: take-back shaft 9 o'clock image, top image, downswing shaft 9 o'clock image, impact image, image previous to impact image, image subsequent to impact image, follow-through shaft 3 o'clock image, and finish image (steps S25, S26).

9 O'Clock Shaft Image in Take-back

The angle of the shaft 12*a* is computed by using two of the colored marks M1 through M3 and by selecting an image in which the shaft 12*a* is nearest a horizontal direction (90°). Thereby the take-back shaft 9 o'clock image is extracted. Alternatively, when one of the colored marks M1 through M3 is used, the take-back shaft 9 o'clock image may be extracted by selecting an image in which an X-direction component of the movement vector of the colored mark is minimum.

It is to be noted that the state in which the shaft 12*a* is 6 o'clock is 0° in its angle and that the clockwise direction is positive.

Top Image

The angle of the shaft 12*a* is computed by using two of the colored marks M1 through M3 and by selecting an image in which the shaft 12*a* has a largest angle. Thereby the top image is extracted. Alternatively, when one of the colored marks M1 through M3 is used, the take-back shaft 9 o'clock image may be extracted by selecting an image in which X-direction and Y-direction components of the movement vector of the colored mark are minimum respectively.

9 O'Clock Shaft Image in Downswing

The angle of the shaft 12*a* is computed by using two of the colored marks M1 through M3 and by selecting an image in which the shaft 12*a* is nearest the horizontal direction (90°) and which is subsequent to the top image. Thereby the downswing shaft 9 o'clock image is extracted. When one of the colored marks M1 through M3 is used, the downswing shaft 9 o'clock image is extracted by selecting an image in which the X-direction component of the movement vector of the colored mark is minimum and which is subsequent to the top image.

Impact Image

The angle of the shaft 12*a* is computed by using two of the colored marks M1 through M3 and by selecting an image in which the shaft 12*a* has an angle nearest 0°. Thereby the impact image is extracted. Alternatively, when one of the colored marks M1 through M3 is used, the impact image may be extracted by selecting an image in which the Y-direction component of the movement vector of the colored mark is minimum. The impact image may be also extracted by using an external trigger signal. The impact image may be also extracted by utilizing a sound generated at an impact time.

Image Previous to Impact Image

The image previous to impact image is extracted by selecting an image obtained by rewinding frames for a predetermined period of time (or predetermined number of frames) with respect to the time when the impact image is extracted.

Image Subsequent to Impact Image

The image subsequent to impact image is extracted by selecting an image obtained by advancing frames for a predetermined period of time (or predetermined number of frames) with respect to the time when the impact image is extracted.

Follow-through Shaft 3 O'Clock Image

The angle of the shaft 12*a* is computed by using two of the colored marks M1 through M3 and by selecting an image in which the shaft 12*a* has an angle nearest −90°. Thereby the follow-through shaft 3 o'clock image is extracted. When one of the colored marks M1 through M3 is used, the follow-through shaft 3 o'clock image is extracted by selecting an image in which the X-direction component of the movement vector of the colored mark is minimum and which is subsequent to the impact image.

Finish Image

The angle of the shaft 12*a* is computed by using two of the colored marks M1 through M3 and by selecting an image in which the angle of the shaft 12*a* is nearest 0°. Thereby the finish image is extracted. When one of the colored marks M1 through M3 is used, the finish image is extracted by selecting an image in which the X-direction and Y-direction components of the movement vector of the colored mark are minimum and which is subsequent to the top image.

The coordinates of positions in the check-point images, such as golfer's joint to be attentively checked, extracted in the above-described manner are recognized to analyze the golfer's swing form (step S27).

The method of extracting the left arm horizontal image in take-back and the downswing left arm horizontal image is described below.

The take-back left arm horizontal image is a still image in which the golfer's left forearm is horizontal at the take-back time. The downswing left arm horizontal image is a still image in which the golfer's left forearm is horizontal at the downswing time.

The following processing of extracting the left arm is executed (step S30), when a current-time image is subsequent to the 6 o'clock shaft image in the take-back time (step S28) and the take-back left arm horizontal image has not been extracted before the current-time image (step S29) is extracted.

To recognize the image in which the golfer's left arm is horizontal, a template having an image region including the left arm is formed to execute template matching processing. An image in which the angle of a matched template is horizontal is determined as the take-back left arm horizontal image.

The golfer 11's contour is extracted to generate the template including the left arm in the still image, as described below.

Initially, an image in which the shaft 12*a* is in the 6 o'clock state obtained from the coordinate of the colored marks M1 through M3 determined by the angle of the shaft 12*a* is extracted. A vector between the colored mark M1 nearest the grip and the colored mark M2 second nearest the grip is computed to decide the position of the grip. More specifically, the position of the grip is computed by the following equation:

$$\text{(Grip position)}=\text{(position of colored mark } M1)-\alpha\times\text{(vector between colored marks)}$$

where α is the ratio of the distance between the colored mark M1 and the grip to the distance between the colored mark M1 and the colored mark M2. In this embodiment, α is 0.5.

Thereafter differential processing is executed between the background image (image in which the golfer 11 is not photographed) and the 6 o'clock shaft image to extract a golfer's silhouette. More specifically, let it be supposed that the value of the R, G, and B in the background image is r', g', and b' respectively and that the value of the R, G, and B of the pixel of the 6 o'clock shaft image is r, g, and b respectively. When the norm (square root of sum of squares of absolute values of difference between r of pixel of one image and r' of pixel of the other image, difference between g of pixel of one image and g' of pixel of the other image, and difference between b of pixel of one image and b' of pixel of the other image) shown by an equation 7 below is less than a predetermined threshold, binarization is executed. That is, the silhouette is not regarded as the golfer's silhouette and the pixels are set to 0. When the norm is not less than the predetermined threshold, the silhouette is regarded as the golfer 11's one and the pixels are set to 1. Labeling of the pixels set to 1 are executed sequentially. In this embodiment, the threshold of the norm is set to 40. Differential processing may be executed between the background image and the 6 o'clock shaft image by using the hue, the saturation, the lightness. In this case, of labeling regions regarded as the golfer's silhouette, one or two regions of not less than 5000 or not less than 10000 are regarded as the golfer's silhouette.

$$\sqrt{(r-r')^2+(g-g')^2+(b-b')^2} \qquad \text{Equation 7}$$

Figure 5A:
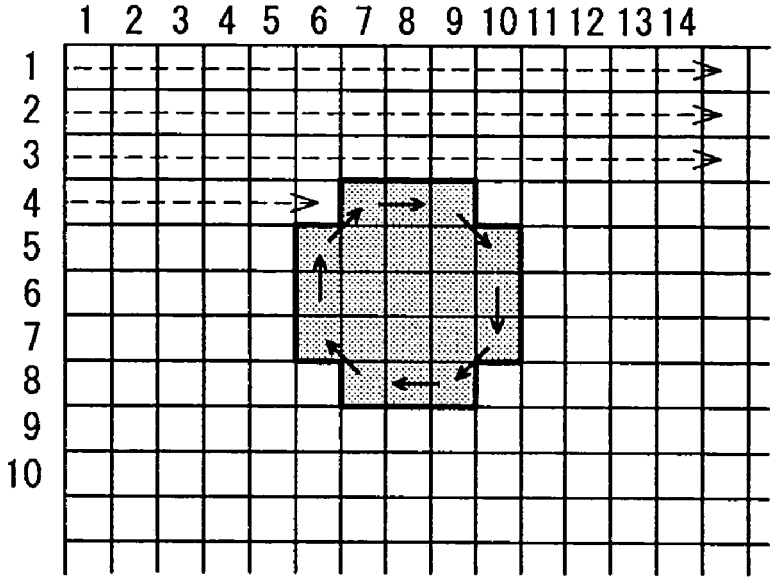
FIGS. 5A and 5B are explanatory views for explaining extraction of the contour of the colored marks.
Figure 5B:
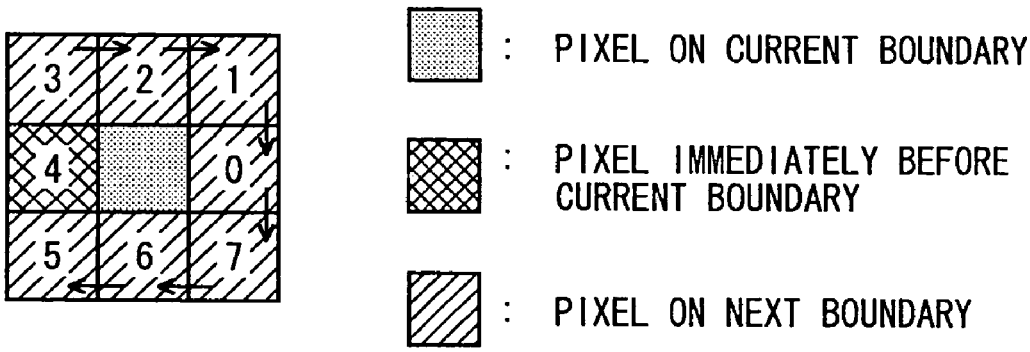

As shown in FIG. 5A, scanning processing of the binarized image is executed to extract the golfer's contour corresponding to pixels of 1 or 2. In the contour extraction method, scanning processing is executed for the labeled image downward in the right-hand direction by using the pixel at the upper left of the frame as the starting point to search pixels of 1 or 2 for the contour extraction. More specifically, a pixel (4, 7) is initially found by the scanning processing. Thereafter as shown in FIG. 5B, seven pixels other than a pixel immediately before the pixel (4, 7) are examined clockwise from an upper left pixel. A pixel having the same label as that of the pixel (1 or 2) found initially is set as the next boundary. This processing is executed sequentially. The contour extraction terminates when the boundary (4, 7) returns to the pixel (4, 7).

Noise remains in the as-extracted contour, as shown in FIG. 5. Thus smoothing is performed by circularly executing movement average processing on the entire contour.

The movement average processing is executed by using an equation 8 shown below:

$$\text{bnd_pt_ido}(n) = \frac{1}{2k+1}\left\{\sum_{i=n-k}^{n+k} \text{bnd_pt}(i)\right\} \qquad \text{Equation 8}$$

where bnd_pt(n) is the coordinate of an n-th contour, k is the number of pixels utilized for calculations before and after the movement average processing is executed, and bnd_pt_ido(n) is the coordinate of the contour after the movement average processing is executed.

Let it be supposed that when the golfer 11's contour is present from a first pixel through a bnd_num-th pixel (last of contour number), a pixel for which the movement average processing is executed is an n-th pixel. When n<k, the movement average processing is executed by utilizing a bnd_num-(k−n)th pixel through a bnd_num-th pixel disposed near the last contour number. When bnd_num−n<k, the movement average processing is executed by utilizing a first pixel through k-(bnd_num−n)th pixel disposed near the first contour number.

Figure 6:
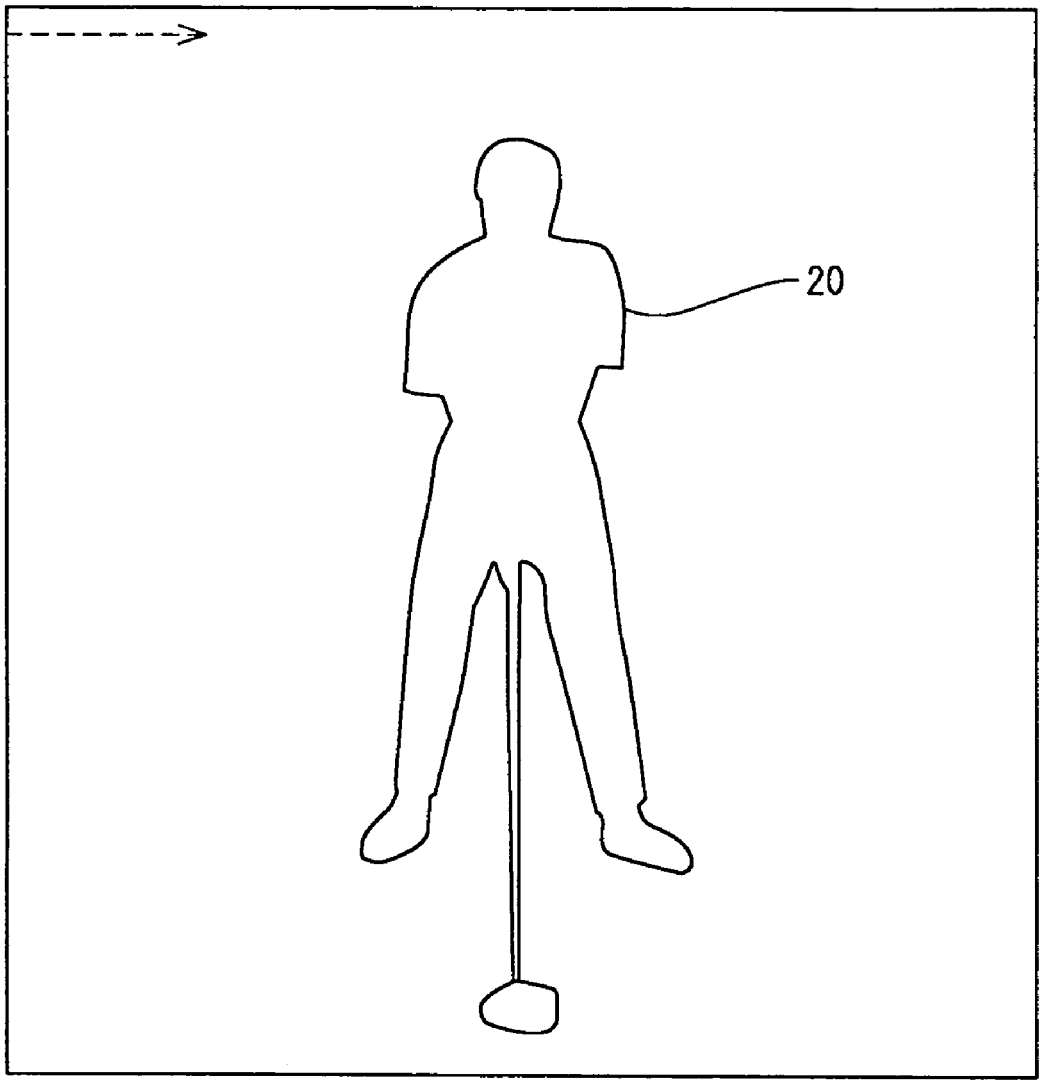
FIG. 6 shows an image in which the golfer's contour has been extracted.

The curvature of the contour is computed from the contour data obtained by the smoothing to obtain the position of the golfer's left shoulder. That is, a portion having a large curvature which appears first is recognized as the golfer's head in scanning an image including the contour data as shown in FIG. 6. A portion having a small curvature which appears thereafter is recognized as the golfer's neck. A portion having a large curvature which appears thereafter is recognized as the golfer's shoulder. In consideration of creases of the golfer's clothes, the curvature of each of pixels of ±5 is computed. The average value of the curvatures should be set as the curvature of the central pixel thereof.

The method of computing the curvature of the contour is described below.

Supposing that the length of a circular arc of a contour to be extracted is S and that the angle thereof is θ, the curvature C is expressed by an equation 9 shown below.

$$C = \frac{d\theta}{dS} \qquad \text{Equation 9}$$

When computations are performed for only a pixel whose curvature is to be found and for points adjacent to the pixel, a correct value cannot be obtained because an obtained value has a large variation. Thus including a row consisting of dots, whose number is k, disposed at both sides of the pixel whose curvature is to be found, the curvature is computed by using an equation 10 shown below:

$$C = \frac{1}{k}\left\{\sum_{i=k+1}^{0} \tan^{-1}\left(\frac{y_{i-1}-y_i}{x_{i-1}-x_i}\right) - \sum_{i=0}^{k-1} \tan^{-1}\left(\frac{y_i-y_{i+1}}{x_i-x_{i+1}}\right)\right\} \qquad \text{Equation 10}$$

In the equation 10, the length S of the circular arc of the contour in the equation 9 is abbreviated to simplify the equation 10. In this embodiment, to further simplify the equation 10, the curvature C is computed in an equation 11 by using both ends of the row of dots.

$$C = \tan^{-1}\left(\frac{y_o-y_{-k}}{x_o-x_{-k}}\right) - \tan^{-1}\left(\frac{y_k-y_o}{x_k-x_o}\right) \qquad \text{Equation 11}$$

Left Arm Horizontal Image in Take-back

Figure 7A:
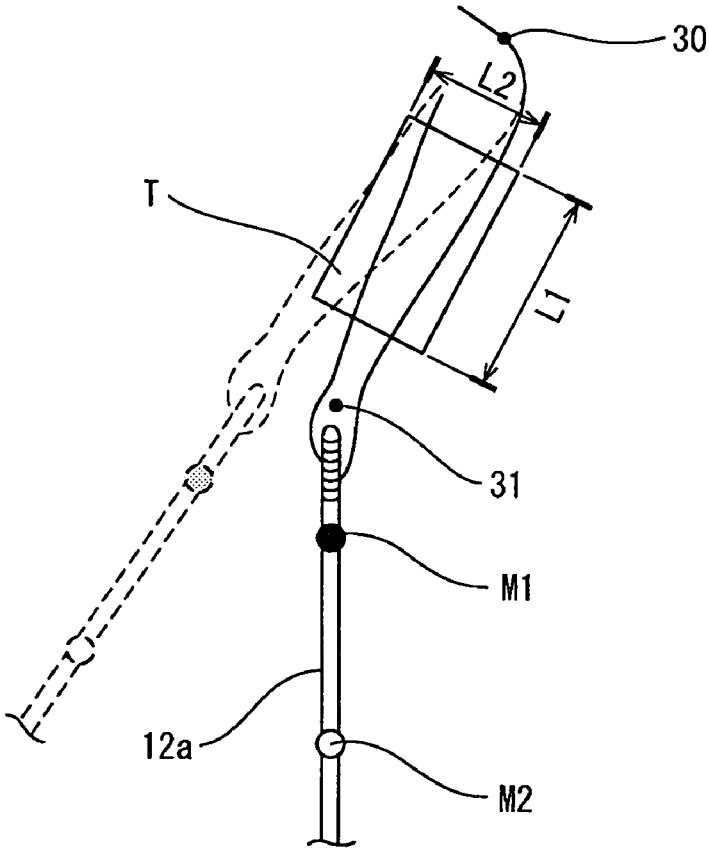
FIGS. 7A and 7B are explanatory views for explaining template matching.

As shown in FIG. 7A, a rectangular template T is set in a region between a left shoulder 30 and a grip 31 both extracted in a manner similar to that described above. The length L1 of the longer side of the template T is set to the half of the length between the shoulder and the grip. The length L2 of the shorter side of the template T is set to such an extent (20 pixels in this embodiment) that the arm is included in the template T.

Figure 7B:
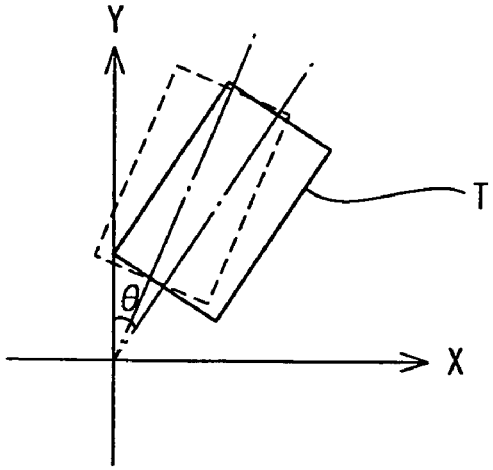
Figure 8:
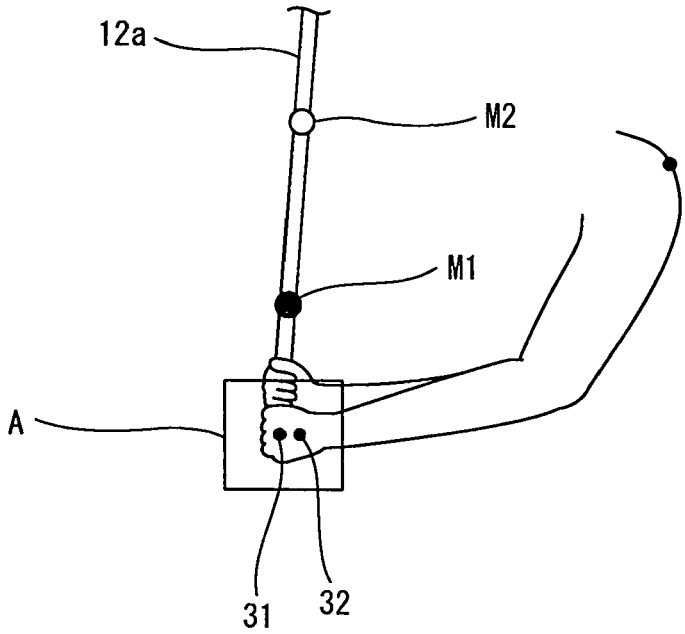
FIG. 8 is an explanatory view for explaining deviation of a grip position.
Figure 9:
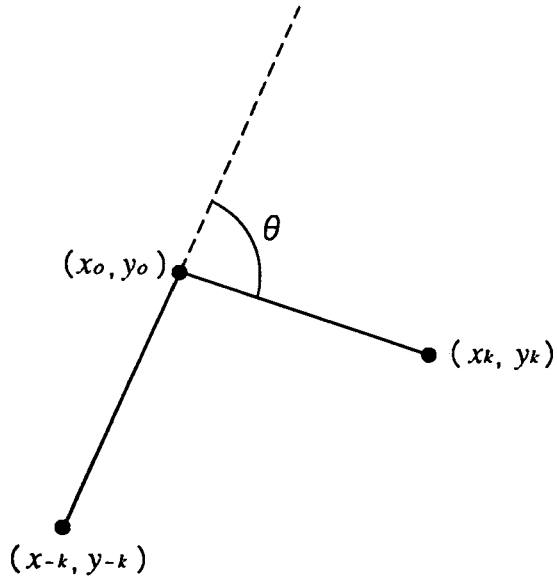
FIG. 9 is an explanatory view for explaining computation of a curvature.

An image at the next time is read to obtain the position of the grip. Thereafter as in the case of the movement vector of the grip position, a parallel movement of the template T of the previous frame is performed. As shown in FIG. 7B, the template T is rotated clockwise on the grip position to 10° at intervals of 1° to compute the angle of the template T at the time when the template T matches the take-back left arm horizontal image. That is, an image in which the angle of the template T is closest to 90° (horizontal) is regarded as the take-back left arm horizontal image and extracted. Thus when the wrist is turned upward as shown in FIG. 8 and when a point present on a vector passing through the colored marks M1 and M2 is supposed to be a grip 31, there is a fear that the grip 31 deviates to some extent from an actual position 32 of the grip. Thus in the present invention, matching processing is executed by rotating the template T to 10° at the intervals of 1° with the grip position 31 obtained by computation set as the center, after making a parallel movement of the rotational center of the template T inside an area A of 10×10 pixels. That is, 10 patterns of rotating the template T to 10° at the intervals of 1° are combined with rotational centers of 100 patterns of 10×10 pixels. Thus matching processing of 1000 patterns of a total of 10×100 pixels is executed.

In the template matching processing, the value of the RGB indicating the color information of pixels inside the template T is converted into a luminance Y for evaluation by using an equation 12 shown below. Although evaluation is made in terms of the luminance Y, the norm (see equation 7) of the RGB may be used for evaluation.

$$Y = 0.299R + 0.587G + 0.114B \qquad \text{Equation 12}$$

In the evaluation, the sum of absolute values of the difference between the values of pixels is used. The sum is shown by an equation 13 shown below:

$$S(p, q, \theta) = \sum_{\theta=0}^{10} \sum_{j=0}^{n-1} \sum_{i=-\frac{n}{2}}^{n/2} |g_t(i_o + i + P,\ j_o + j + q,\ \theta + \alpha) - g_{t-1}(i_o + i,\ j_o + j,\ \alpha)| \qquad \text{Equation 13}$$

where t is a current frame, t−1 is a frame previous by one frame to the current frame, (p, q) is a range in which parallel movement is executed, $(i_o, j_o)$ is the position of the grip, m is the number of pixels of the longer side of the template T, n is the number of pixels of the shorter side of the template, θ is the rotational angle of the template T, α is the angle of the template T found by one frame previous to the current frame, $g_t$ (x, y, θ) is a function indicating the luminance Y (or norm of RGB) of a pixel when the angle of the template T is θ at a coordinate (x, y).

The position and angle (p, q, θ) of the template T are changed in the above conditions to compute the length S (p, q, θ) of the circular arc of the contour. The template is regarded as matching the take-back left arm horizontal image to a highest extent at the position and angle making this value minimum. An image in which the value of θ of the (p, q, θ) when the template matches the take-back left arm horizontal image is closest to 90° is extracted as the take-back left arm horizontal image (step S31).

When the take-back left arm horizontal image cannot be extracted by the above processing, namely, when the template T does not form an angle of 90°, even though the shaft 12*a* forms an angle of 240° or more by advancing the time of the swing moving image from the address image, a still image a predetermined period of time (fifth frame after the time of take-back shaft 9 o'clock image in this embodiment) after the time of the take-back shaft 9 o'clock image is regarded as the take-back left arm horizontal image (step S32). It is to be noted that the state in which the shaft 12*a* is 6 o'clock is 0° in its angle and that the clockwise direction is positive.

In the take-back left arm horizontal image extracted in the above-described manner as one of the check-point images, the coordinates of positions such as golfer's joint to be attentively checked are recognized to analyze the golfer's swing form (step S33).

Left Arm Horizontal Image in Downswing

The template including the left arm in the take-back left arm horizontal image obtained as described above is utilized to extract an image, subsequent to the top image, matching the template to a highest extent as the downswing left arm horizontal image.

As apparent from the above description, in the extraction order of the images of the swing, the downswing left arm horizontal image is extracted after the top image is extracted. Thus the template matching processing may be started from the top image. However, it takes much time to execute the template matching processing from the top image or the entire arm is not necessarily seen in the top image. Thus there is a possibility of an erroneous recognition.

Therefore in the embodiment, the downswing left arm horizontal image is extracted by extracting the downswing shaft 9 o'clock image initially and executing the template matching processing by putting back a clock. Thereby it is possible to shorten a computing period of time and prevent an erroneous recognition.

That is, when the downswing shaft 9 o'clock image has been extracted (step S34), the left arm is extracted by putting back a clock from the time of the downswing shaft 9 o'clock image. Thereby an image that matches the template to the highest extent is regarded as the downswing left arm horizontal image (step S35).

In the downswing left arm horizontal image extracted in the above-described manner as one of the check-point images, the coordinates of positions such as the golfer 11's joint to be attentively checked are recognized to analyze the golfer 11's swing form (step S36).

Shaft 8 O'Clock Image in Take-back

The method of extracting the take-back shaft 8 o'clock image is described below. The take-back shaft 8 o'clock image means a still image which is placed at an eight o'clock position at the take-back time, when the shaft is regarded as the needle of a clock.

The width (stance width) of the golfer 11's body is obtained by extracting the golfer's silhouette at the above-described shaft 6 o'clock image. Then an image at the time when a perpendicular passing through the side of the right leg and the colored mark M1 intersect with each other is selected as the take-back shaft 8 o'clock image and extracted.

Figure 11:
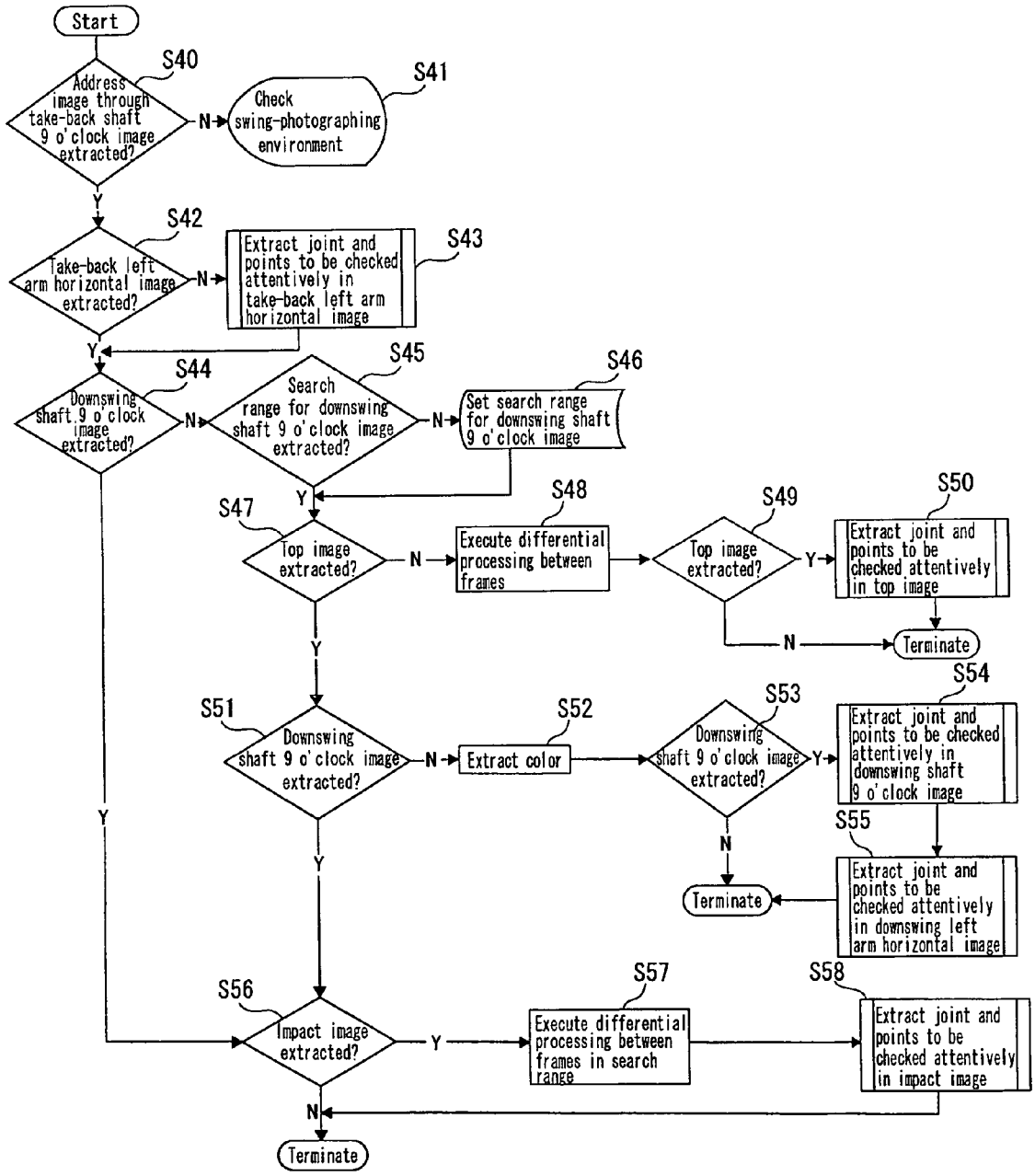
FIG. 11 is a flowchart showing a check-point extraction algorithm for failure in automatic tracing.

Then the second search routine (step S19) of the check-point extraction algorithm for failure in automatic tracing is described in detail below with reference to FIG. 11.

Initially, whether images from the address image through the take-back shaft 9 o'clock image have been extracted is checked (step S40). More specifically, if the shaft angle is 90° or more immediately before the second search routine is executed, there is a high possibility that the colored marks M1 through M3 are erroneously recognized as the golfer's cloth or the background. Thus a message of "check the environment in which the swing is photographed" is displayed on a monitor 16 (step S41).

Thereafter it is checked whether the take-back left arm horizontal image has been extracted (step S42). If the second search routine is executed before the take-back left arm horizontal image is extracted by the template matching processing, a still image a predetermined period of time (five frames (5/60 seconds) after the time of the take-back shaft 9 o'clock image) the time of the take-back shaft 9 o'clock image is regarded as the take-back left arm horizontal image and extracted to recognize the coordinate of the to-be-checked positions of the take-back left arm horizontal image such as the golfer's knee. In this manner, the swing form is analyzed (step S43).

Thereafter whether or not the downswing shaft 9 o'clock image has been extracted (step S44). If the downswing shaft 9 o'clock image has not been extracted, a search range is set in advance with the coordinate of the position of each of the colored marks M1 through M3 in the take-back shaft 9 o'clock image set as the center of the search range to prepare extraction processing of the downswing shaft 9 o'clock image which will be described later (step S45).

Thereafter whether or not the top image has been obtained is checked (step S47). If the top image has not been obtained, differential processing is executed sequentially at different times between adjacent still images (frames) in time series before and after the top image (step S49). A still image subsequent to the take-back left arm horizontal image in which the number of pixels whose norm is larger than the predetermined threshold becomes a minimum value initially is regarded as the top image. More specifically, the norm value of each pixel computed in a manner similar to that in the equation 7 is computed on a current frame and a frame previous to the current frame. In images from the address image through the top image, there is a decrease in the number of pixels whose norm value obtained in the differential processing is larger than the predetermined threshold (30 in the embodiment). On the other hand, in images subsequent to the tom image, there is an increase in the number of pixels whose norm value obtained in the differential processing is larger than the predetermined threshold. Thus when the increase in the number of pixels continues by five frames or more, an image previous by five frames is extracted as the top image.

The coordinates of positions of the obtained top image such as the golfer's joint to be attentively checked are recognized to analyze the golfer 11's swing form (step S50).

Thereafter whether or not the downswing shaft 9 o'clock image has been obtained is checked (step S51). If the downswing shaft 9 o'clock image has not been obtained, binarization is executed in the predetermined search range to perform color extraction for recognizing the colored marks M1 through M3 (step S52). When there are two or three of the colored marks M1 through M3, the angle of the shaft 12*a* is computed from a vector between the colored marks M1 through M3, and an image in which the angle of the shaft 12*a* is closest to 90° (horizontal) is extracted as the downswing shaft 9 o'clock image (step S53). Thereafter the coordinates of positions of the obtained downswing shaft 9 o'clock image such as golfer's joint to be attentively checked are recognized to analyze the golfer's swing form (step S54).

An image a predetermined period of time (five frames (5/60 seconds) in this embodiment) before the time of the downswing shaft 9 o'clock image is obtained as the take-back left arm horizontal image. The coordinates of positions of both obtained images such as the golfer's joint to be attentively checked are recognized to analyze the golfer's swing form (step S55).

Thereafter if the impact image has not been extracted (step S56), a search range in which the area occupied by the ball 20 is 10% to 100% thereof is set in the image. In this search range, the differential processing is executed sequentially in time series between a pair of still images continuous in time series. The norm value of each pixel computed in a manner similar to that in the equation 7 is computed on a current frame and a frame previous to the current frame. When a still image in which the number of pixels whose norm value is larger than the predetermined threshold (30 in the embodiment) starts to increase and when the counted number of the pixels exceeds another threshold (50 in the embodiment), the image is regarded as the impact image (step S57). The reason the search range search range in which the area occupied by the ball 20 is 10% to 100% thereof is set in the image is as follows: If the search range in which the area occupied by the ball 20 is set to less than 10%, it is easy to obtain an operation other than the collision between the golf club head and the ball 20 as the number of pixels whose norm is larger than the predetermined threshold. In this embodiment, the number of pixels of the ball 20 is set to 49, and the search range of 20×20=400 pixels is set with the ball 20 disposed at the center of the search range.

Supposing that an image previous to the impact image by a predetermined number of frames is extracted as the image previous to impact image, whereas an image subsequent to the impact image by a predetermined number of frames is extracted as the image subsequent to impact image.

The coordinates of the positions of these images such as the golfer's joint to be attentively checked are recognized to analyze the swing form (step S58).

Figure 12:
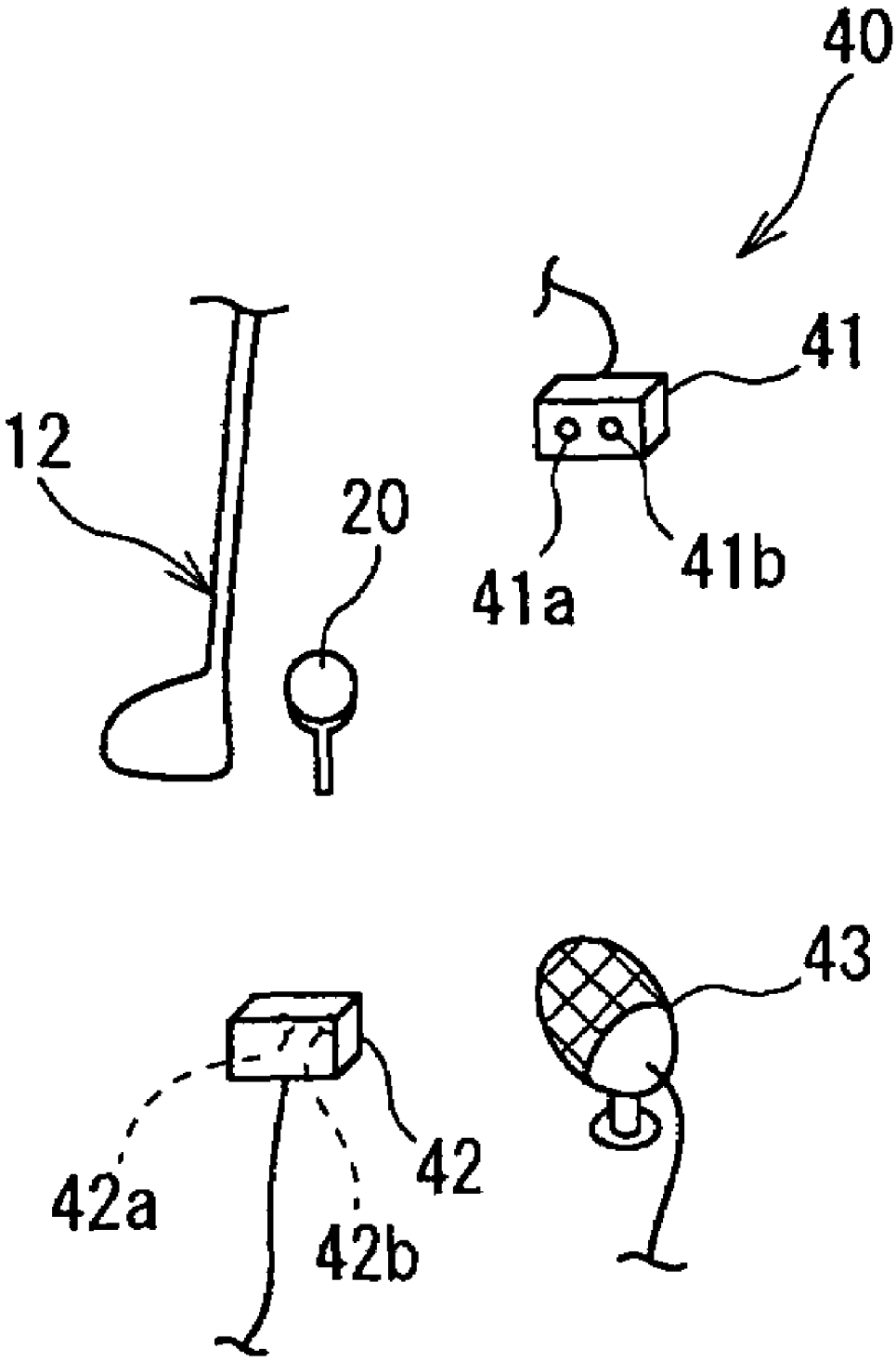
FIG. 12 shows a detection sensor and a sound collection means.

The method of extracting the impact image can be executed on the condition that the ball 20 can be extracted. If the ball has not been extracted, as shown in FIG. 12, a detection sensor 40 that detects the passage of the golf club 12 may be provided at a predetermined position in the vicinity of the ball 20 with the detection sensor 40 connected to the computer 15. The detection sensor 40 detects the passage of the golf club 12 and transmits a trigger signal to the computer 15. Based on the trigger signal, the position of the club head is estimated and the impact image, the image previous to impact image, and the image subsequent to impact image are extracted. The detection sensor 40 is constructed of a pair of projectors 41 and a pair of receptors 42. The projectors 41 have two light-projecting parts 41*a*, 41*b* emitting infrared rays. The receptors 42 have two light-receiving parts 42*a*, 42*b* detecting the infrared rays.

As another method, a microphone (sound collection means) 43 may be provided in the vicinity of the ball 20 with the microphone 43 connected to the computer 15. The microphone 43 detects a sound generated when the golf club 12 hits the ball 20. A still image at the time when the sound recognized as the hitting sound is obtained is regarded as the impact image and extracted.

When the colored marks M1 through M3 attached to the shaft 12*a* become proximate to the golfer's face during the swing, there is a possibility that the skin color of the golfer's face is erroneously recognized as the color or colors of the colored marks M1 through M3 in the color extraction that is executed by using the binarization. To solve this problem, after the differential processing is executed between the still image and the background image in the color extraction processing, skin extraction is executed by regarding an aggregate region of pixels satisfying the conditions (color range) of the hue θ=0 to 30, R=20 to 255, G=20 to 180, and B=not more than 180 as a skin color range. The binarization is not executed for the skin color range in an assumption that the colored marks M1 through M3 are not present in the skin color range.

Figure 13:
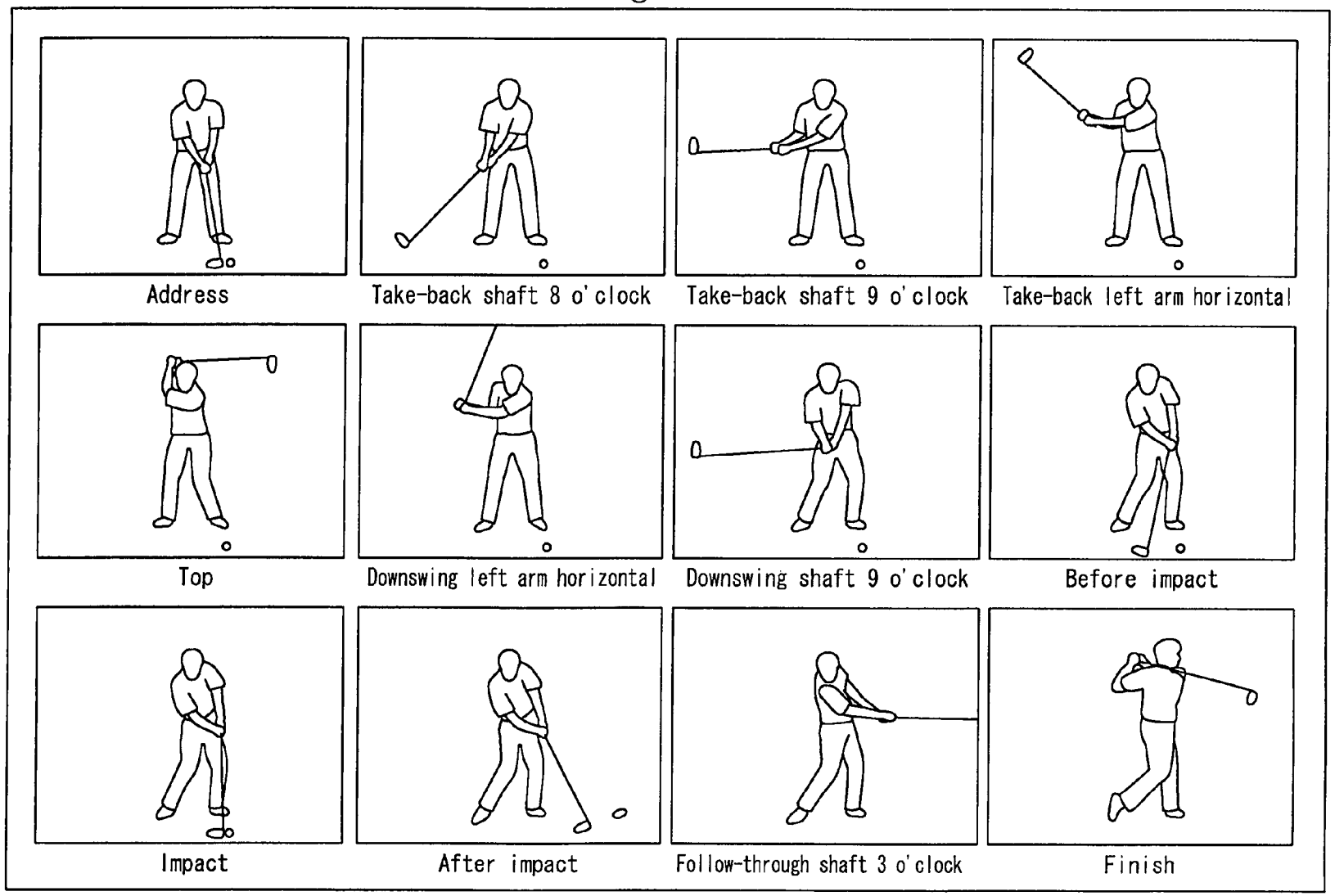
FIG. 13 shows check-point images viewed from a front side.
Figure 14:
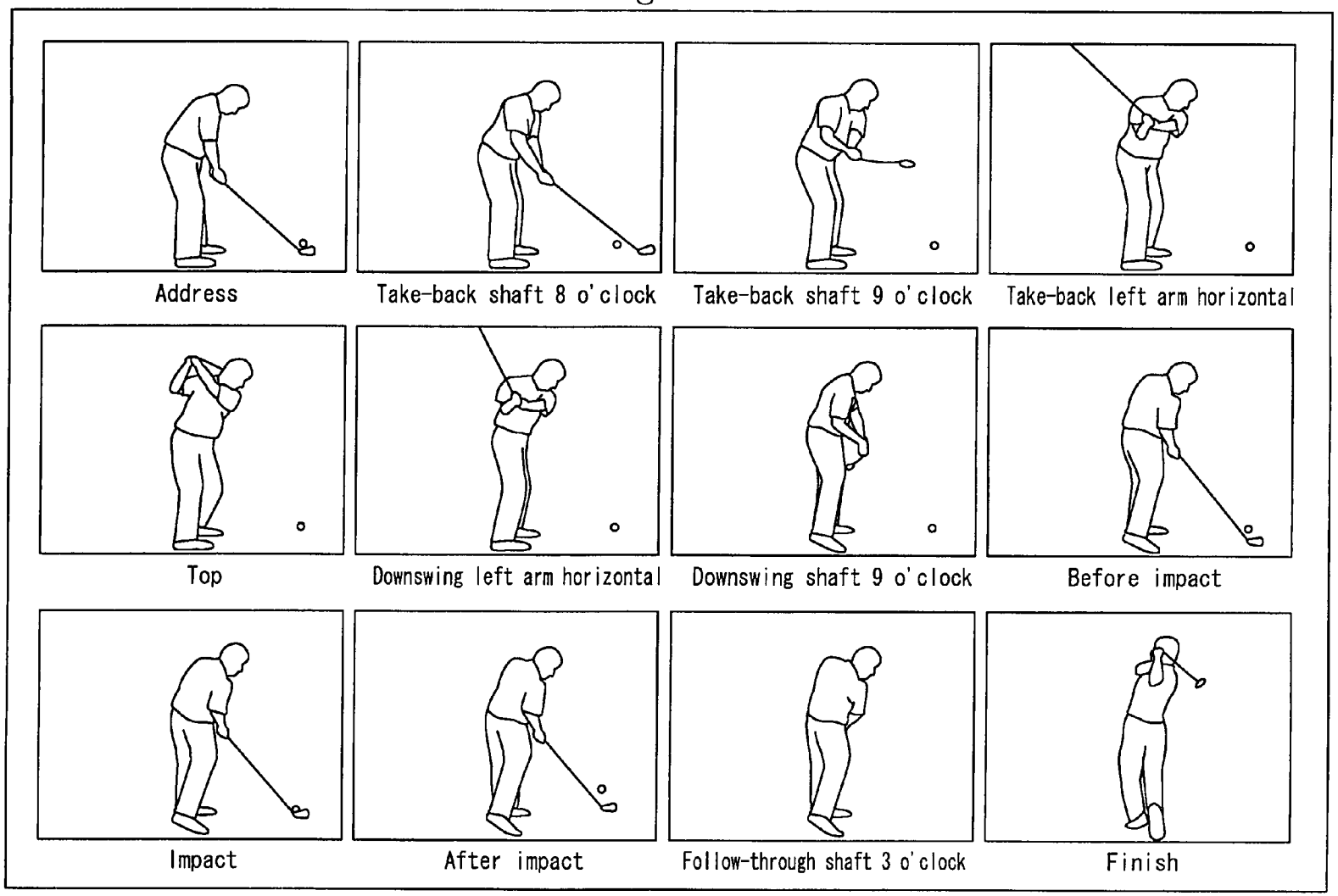
FIG. 14 shows check-point images viewed rearward in a ball fly line.

As shown in FIGS. 13 and 14, the check-point images obtained in the above-described manner are outputted as images in a front view and in a view when the golfer is seen rearward from the golfer in a ball fly line to have the swing diagnosed by a professional (teacher). Alternatively the golfer may examine her/his swing for each of the check-point images. The check-point images shown in FIGS. 13 and 14 may be outputted to a monitor 16, a printer or an external recording medium such as a CD-R. Alternatively data of the check-point images may be transmitted through the internet.

An example of a diagnosis content of each check-point image is described below.

In the address image, the length of the stance, the ball-placing position, how to grip the golf club, and the like are diagnosed. It can be the that they are most important in the golf swing.

In the take-back shaft 8 o'clock image, how to raise a golf club is observed to check the orbit of the swing and whether the golfer intends to hit a ball by only her/his arm.

In the take-back shaft 9 o'clock image, the orientation of the face of the golf club head is observed.

In the take-back left arm horizontal image, the extent of a cock, the orbit of the swing at the take-back time, and the like are observed.

In the top image, observation is made on whether the golfer has an over-swing, the orientation of the shaft when the golfer is viewed rearward from the golfer, the motion of the golfer's head, the motion of the upper half of the golfer's body, and the motion of the lower half thereof when the golfer is seen rearward from the golfer in a ball fly line.

In the downswing left arm horizontal image and the downswing shaft 9 o'clock image, the extent of the cock, the orbit of the swing at the take-back time, and the like are observed.

In the image previous to impact image, the impact image, and the image subsequent to impact image, observation is made on the orbit of the swing, the motion of the golfer's head, the motion of the upper half of the golfer's body, and the motion of the lower half thereof.

In the follow-through shaft 3 o'clock image, the motion of the upper half of the golfer's body, the motion of the lower half thereof, and the like are observed.

In the finish image, the motion of the upper half of the golfer's body is observed.

As apparent from the foregoing description, a large number of images during the swing is not checked, but only important images are extracted. Thereby the professional (teacher) can diagnose the swing easily and appropriately.

It is preferable to measure a ball speed, a deviation angle, an elevation angle, a spin amount in hitting the golf ball. It is favorable to diagnose the swing by checking the automatically extracted check-point images in combination with the results of the measurement.

What is claimed is:

1. A golf swing diagnosis system comprising a computer for capturing a colored moving image obtained by photographing a golfer who swings by gripping a golf club having colored marks attached to a shaft thereof, wherein said computer comprises:

a means for converting said colored moving image into a plurality of still images;

a means for executing binarization for each pixel of a plurality of said still images by using a specific threshold of color information and recognizing pixels, of said still images, which satisfy said threshold as positions of said colored marks so as to obtain coordinate data of each of said colored marks;

an operation extraction means for recognizing a movement of said golf club shaft by using a movement vector amount of one of said colored marks computed based on said coordinate data of each of said colored marks or by using a vector angle between two of said colored marks;

an image extraction means for selectively extracting still images necessary for diagnosing a golf swing from a plurality of said still images, based on data obtained by said operation extraction means; and an output means for outputting said extracted still images.

2. The golf swing diagnosis system according to claim 1, wherein said the extracted still images necessary for diagnosing said golf swing are check-point images including an impact image and one or more swing postures other than said impact image.

3. The golf swing diagnosis system according to claim 1, wherein said operation extraction means automatically traces a position of each of said colored marks of each still image by storing automatically recognized color information of red, green, and blue of each of said colored marks of one still image as reference color information; sets an allowable range of a color regarded as the same color as said reference color; sets on a subsequent still image a search range which is a region including an estimated position of each of said colored marks in a still image of said subsequent still image adjacent to said one still image in time series; and regards pixels falling in said color range as said positions of said colored marks in said search range.

4. The golf swing diagnosis system according to claim 3, wherein when said colored marks cannot be traced, binarization is executed again on each pixel in said search range by using said specific threshold of said color information to obtain coordinate data by regarding pixels satisfying said threshold as positions of said colored marks.

5. The golf swing diagnosis system according to claim 1, wherein said operation extraction means extracts a swing posture by using a movement vector amount between still images, of one of said colored marks provided on said shaft, adjacent to each other in time series;

said image extraction means extracts a still image at an impact time and one or more images of a swing posture selected from among a take-back shaft 9 o'clock image, a top image, a downswing shaft 9 o'clock image, a follow-through shaft 3 o'clock image, and a finish image as check-point images.

6. The golf swing diagnosis system according to claim 1, wherein said operation extraction means extracts a swing posture by using a vector angle between two or more of said colored marks provided on said shaft at certain intervals or/and a movement vector amount of one of said colored marks near a grip; and said image extraction means extracts a still image at an impact time and one or more images of a swing posture selected from among a take-back shaft 9 o'clock image, a top image, a downswing shaft 9 o'clock image, a follow-through shaft 3 o'clock image, and a finish image as check-point images.

7. The golf swing diagnosis system according to claim 1, wherein said operation extraction means executes background subtraction of said still images by using a background image in which a golfer is not photographed to obtain a golfer's silhouette; extracts a contour of said silhouette; regards a pixel which makes a curvature of said contour extreme as an unskillful arm side shoulder; computes a position of a grip from a positional relationship between two of said colored marks; stores at least one part of said still images in a range from said shoulder at said unskillful arm side to said grip as a template; and extracts a movement of a golfer's unskillful arm by executing template matching processing for a still image during a take-back swing; and said image extraction means regards a still image in which said template has become horizontal as an image in which said unskillful arm is horizontal in said take-back swing, based on data obtained by said operation extraction means, thus extracting said still image as a check-point image.

8. The golf swing diagnosis system according to claim 7, wherein said image extraction means stores at least one part of said images in said range from said shoulder to said grip in said still image in which said unskillful arm is horizontal in said take-back swing as a template; and executes template matching processing for said still image in a downswing and regards a frame of an image that matches said template to a highest extent as said still image in which said unskillful arm is horizontal in said downswing, thus extracting said image that matches said template to the highest extent as a check-point image.

9. The golf swing diagnosis system according to claim 1, wherein said image extraction means executes differential processing for said still image by using a background image in which a golfer is not photographed to obtain said golfer's silhouette and obtain one end of said silhouette as a side of a golfer's leg at the skillful arm side from a left-to-right width of said silhouette; and regards an image at a time when a perpendicular passing through said side of said leg at the skillful arm side intersects with said colored mark attached to said shaft as a take-back shaft 8 o'clock image, thus extracting said take-back shaft 8 o'clock image as a check-point image.

10. The golf swing diagnosis system according to claim 1, wherein said image extraction means regards a photographed first swing image as an address image or regards a still image in which a differential is minimum when differential processing is executed between still images from a start time of an extraction of said swing images as said address image, thus extracting said address image as a check-point image.

11. The golf swing diagnosis system according to claim 1, wherein when recognition of said colored marks has failed in executing binarization for pixels of each of said still images by using a specific threshold of color information, of a plurality of said still images constructing said color moving image, differential processing is executed between a pair of still images spaced at a certain time interval so as to regard one of said still images in which the number of pixels whose norm is larger than a predetermined threshold becomes a minimum value as a top image and extract said top image as a check-point image.

12. The golf swing diagnosis system according to claim 1, wherein when recognition of said colored marks has failed, an extraction of a downswing shaft 9 o'clock image has failed, and an extraction of a take-back shaft 9 o'clock image has succeeded in executing binarization for pixels of each of said still images by using a specific threshold of color information, a search range is set on said still image by setting a coordinate of a position of each of said colored marks in said take-back shaft 9 o'clock image as a reference, and an allowable color range regarded as the same color as that of each of said colored marks is set on said still image;

a pixel falling in said color range is regarded as a position of each of said colored marks in said search range so as to recognize said coordinate of said position of each of said colored marks in said take-back shaft 9 o'clock image; and an image in which a vector between two or more of said colored marks is most horizontal is regarded as said downswing shaft 9 o'clock image so as to extract said downswing shaft 9 o'clock image as a check-point image.

13. The golf swing diagnosis system according to claim 1, wherein a search range having a predetermined area is set on a periphery of a ball in a still image; and differential processing is executed between a pair of still images spaced at a certain time interval so as to regard a still image at a time when the number of pixels whose norm value is larger than a predetermined threshold starts to increase or at a time when the number of said pixels whose norm value is larger than said predetermined threshold exceeds another threshold as an impact image so as to extract said impact image as a check-point image.

14. The golf swing diagnosis system according to claim 1, wherein a detection sensor that detects a passage of a golf club is provided in the vicinity of a ball so that based on a trigger signal outputted from said detection sensor, an impact image is extracted from a plurality of said still images.

15. The golf swing diagnosis system according to claim 1, wherein a sound collection means connected with a computer is provided so that based on a sound generated when said golf club hits a ball, an impact image is extracted from a plurality of said still images.

16. The golf swing diagnosis system according to claim 1, wherein an allowable range of a color regarded as the same color as that of a golfer's skin is set; a skin extraction is executed by regarding a pixel falling in said color range of said pixel-color information in a plurality of said still images as a golfer's skin-color range; and binarization is not executed for said skin-color range in an assumption that said colored marks are not present in said skin-color range.

17. A golf swing diagnosis system comprising a computer for capturing a colored moving image obtained by photographing a golfer who swings by gripping a golf club having colored marks attached to a shaft thereof, wherein said computer comprises:

a means for converting said colored moving image into a plurality of still images;

a means for executing binarization for each pixel of a plurality of said still images by using a specific threshold of color information and recognizing pixels, of said still images, which satisfy said threshold as positions of said colored marks so as to obtain coordinate data of each of said colored marks;

an operation extraction means for executing differential processing of said still image by using a background image in which a golfer is not photographed to obtain a golfer's silhouette; extracting a contour of said silhouette; regarding a pixel which makes a curvature of said contour extreme as an unskillful arm side shoulder; computing a position of said grip from a positional relationship between two of said colored marks; storing at least one part of images in a range from said shoulder at said unskillful arm side to said grip as a template; and extracting a movement of a golfer's unskillful arm by executing template matching processing for a still image during a take-back portion of the golf swing; and an image extraction means for regarding a still image in which said template has become horizontal as an image in which said unskillful arm is horizontal in said take-back portion of the golf swing, based on data obtained by said operation extraction means, thus extracting said still image as a check-point image.

18. The golf swing diagnosis system according to claim 17, wherein said image extraction means stores at least one part of said images in said range from said shoulder to said grip in said still image in which said unskillful arm is horizontal in said take-back swing as a template; and executes template matching processing for said still image in a downswing portion of the swing and regards a still image that matches said template to a highest extent as said still image in which said unskillful arm is horizontal in said downswing, thus extracting said image that matches said template to the highest extent as a check-point image.

19. A golf swing diagnosis system comprising a computer for capturing a colored moving image obtained by photographing a golfer who swings by gripping a golf club having colored marks attached to a shaft thereof, said computer comprising:

a means for converting said colored moving image into a plurality of still images;

an image extraction means for executing differential processing for said still images by using a background image in which a golfer is not photographed to obtain said golfer's silhouette and obtain one end of said silhouette as a side of a golfer's leg at the skillful arm side from a left-to-right width of said silhouette; and regarding an image at a time when a perpendicular passing through said side of said leg at the skillful arm side intersects with said colored marks attached to said shaft as a take-back shaft 8 o'clock image, thus extracting said take-back shaft 8 o'clock image as a check-point image; and an output means for outputting said extracted still images.

20. A golf swing diagnosis system comprising a computer for capturing a colored moving image obtained by photographing a golfer who swings by gripping a golf club having colored marks attached to a shaft thereof, said computer comprising:

a means for converting said colored moving image into a plurality of still images;

an image extraction means for regarding a photographed first swing image as an address image or regarding a still image in which a differential is minimum when differential processing is executed between still images from a start time of an extraction of said plurality of swing images as said address image, thus extracting said take-back shaft 8 o'clock image as a check-point image; and an output means for outputting said extracted still images.

21. A golf swing diagnosis system comprising a computer for capturing a colored moving image obtained by photographing a golfer who swings by gripping a golf club having colored marks attached to a shaft thereof, wherein said computer comprises:

a means for converting said colored moving image into still images;

a means for executing binarization for each pixel of said still images by using a specific threshold of color information and recognizing pixels, of said still images, which satisfy said threshold as positions of said colored marks so as to obtain coordinate data of each of said colored marks;

an operation extraction means for recognizing a movement of said golf club shaft by using a movement vector amount of one of said colored marks computed based on said coordinate data of each of said colored marks or by using a vector angle between two of said colored marks;

an image extraction means for selectively extracting one still image necessary for diagnosing a golf swing from a plurality of said still images, based on data obtained by said operation extraction means; and an output means for outputting the one extracted still image.

* * * * *